US008481238B2

(12) United States Patent
Zhao et al.

(10) Patent No.: US 8,481,238 B2
(45) Date of Patent: Jul. 9, 2013

(54) ELECTROPHOTOGRAPHIC PHOTORECEPTORS, ELECTROPHOTOGRAPHIC PHOTORECEPTOR CARTRIDGE, AND IMAGE-FORMING APPARATUS

(75) Inventors: Rui Zhao, Kanagawa (JP); Yuka Nagao, Kanagawa (JP); Teruyuki Mitsumori, Tokyo (JP); Tadashi Mizushima, Kanagawa (JP); Shunichiro Kurihara, Kanagawa (JP); Takayuki Shoda, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 642 days.

(21) Appl. No.: 12/664,063

(22) PCT Filed: Jun. 11, 2008

(86) PCT No.: PCT/JP2008/060717

§ 371 (c)(1),
(2), (4) Date: Mar. 10, 2010

(87) PCT Pub. No.: WO2008/153084

PCT Pub. Date: Dec. 18, 2008

(65) Prior Publication Data

US 2010/0183332 A1 Jul. 22, 2010

(30) Foreign Application Priority Data

Jun. 11, 2007 (JP) ..... P. 2007-154380
Aug. 6, 2007 (JP) ..... P. 2007-204779
Jan. 10, 2008 (JP) ..... P. 2008-003693
Jan. 10, 2008 (JP) ..... P. 2008-003725

(51) Int. Cl.
*G03G 5/00* (2006.01)

(52) U.S. Cl.
USPC ..... 430/96; 430/56; 430/58.85; 430/69

(58) Field of Classification Search
USPC ..... 430/56, 58.05, 58.35, 58.85, 69, 430/96
See application file for complete search history.

(56) References Cited

U.S. PATENT DOCUMENTS 7,604,913 B2 * 10/2009 Tajima et al. ..... 430/59.6
2007/0026334 A1 2/2007 Morita et al.

FOREIGN PATENT DOCUMENTS

JP 6 348045 12/1994
JP 06348045 A * 12/1994

(Continued)

OTHER PUBLICATIONS

English Translation of JP-06348045A.*

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

An electrophotographic photoreceptor is provided which comprises a conductive substrate and a photosensitive layer formed thereover, wherein the photosensitive layer contains at least a polyarylate resin having a repeating structure represented by the following formula [1] and a compound represented by the following formula [6]. This photoreceptor has excellent abrasion resistance under practical load, has high mechanical strength, and further has highly excellent electrical properties.

[1]

[6]

14 Claims, 2 Drawing Sheets

FOREIGN PATENT DOCUMENTS

| | | | |
|---|---|---|---|
| JP | 8 283708 | | 10/1996 |
| JP | 11-305462 | | 11/1999 |
| JP | 2002 265575 | | 9/2002 |
| JP | 2004 264351 | | 9/2004 |
| JP | 2006-215539 | | 8/2006 |
| JP | 2007-121751 | | 5/2007 |
| WO | WO 2006009126 | A1 * | 1/2006 |
| WO | WO 2007/078006 | A1 | 7/2007 |

OTHER PUBLICATIONS

Chinese Office Action issued Apr. 27, 2012, in Patent Application No. 200880019425.X (with English-language translation).

Chinese Office Action issued Jun. 9, 2011, in Patent Application No. 200880019425.X (with English-language translation).

U.S. Appl. No. 12/857,271, filed Aug. 16, 2010, Nagao, et al.

Office Action issued Nov. 9, 2012 in Japanese Application No. 2008-153595 (With English Translation).

Office Action issued Nov. 9, 2012 in Japanese Application No. 2008-153597 (With English Translation).

Office Action issued Nov. 9, 2012 in Japanese Application No. 2008-153599 (With English Translation).

Chinese Office Action Issued Dec. 18, 2012 in Patent Application No. 200880019425.X (with English translation).

* cited by examiner

ELECTROPHOTOGRAPHIC PHOTORECEPTORS, ELECTROPHOTOGRAPHIC PHOTORECEPTOR CARTRIDGE, AND IMAGE-FORMING APPARATUS

TECHNICAL FIELD

The present invention relates to electrophotographic photoreceptors for use in copiers, printers, and the like, and to an electrophotographic photoreceptor cartridge and an image-forming apparatus. More particularly, the invention relates to electrophotographic photoreceptors having excellent wearing resistance and satisfactory in responsiveness, electrical properties, or repeatability, an electrophotographic photoreceptor cartridge, and an image-forming apparatus.

BACKGROUND ART

Electrophotography has advantages such as excellent instantaneousness and the ability to give high-quality images, and is hence used extensively in the fields of copiers, various printers, and printing machines. As electrophotographic photoreceptors serving as the core of electrophotography, use is being made of electrophotographic photoreceptors (hereinafter, also referred to simply as "photoreceptors") employing an organic photoconductive material which has advantages such as non-polluting properties, ease of film formation, and ease of production.

Known electrophotographic photoreceptors employing an organic photoconductive material include: a so-called dispersion type single-layer photoreceptor including photoconductive fine particles dispersed in a binder resin; and a multilayer type photoreceptor having superposed layers including a charge-generating layer and a charge-transporting layer. The multilayer type photoreceptor has the following advantages. The multilayer type photoreceptor can be obtained as a high-sensitivity photoreceptor by using a charge-generating material having a high efficiency in combination with a charge-transporting material having a high efficiency. There is a wide choice of materials, and highly safe photoreceptors are hence obtained. Furthermore, since the photosensitive layer can be easily formed by coating fluid application, the multilayer type photoreceptor has high productivity and is advantageous also from the standpoint of cost. For these reasons, photoreceptors of the multilayer type are mainly used, and are being diligently developed and put to practical use.

On the other hand, the single-layer type photoreceptor is slightly inferior in electrical properties to the multilayer type photoreceptor and has a slightly lower degree of freedom of material selection. However, the single-layer type photoreceptor can generate charges in an area near the photoreceptor surface and, hence, can be used to attain higher resolution. Furthermore, even when the photosensitive layer is formed thickly, this does not result in image blurring. The single-layer type photoreceptor hence has an advantage that printing durability can be enhanced by increasing the film thickness. In addition, the single-layer type photoreceptor has an advantage that a cost reduction is possible for the following and other reasons: a smaller number of coating steps suffice for the photoreceptor; this photoreceptor is advantageous for diminishing the interference fringes attributable to conductive bases (substrates) or mitigating pipe defects; and inexpensive bases such as, e.g., pipes which have not been machined, can be used.

Although the electrophotographic photoreceptors employing an organic photoconductive material have the advantages described above, these photoreceptors do not satisfy all the properties required of electrophotographic photoreceptors. Such electrophotographic photoreceptors are desired to be further improved especially in high sensitivity, low residual potential, and durability.

As a result of a growing demand for high-speed printing, there is a desire for materials usable in higher-speed electrophotographic processes. Besides having high sensitivity and a long life, the photoreceptor in this case is required to have satisfactory responsiveness because the time period from exposure to development is shorter. Although the responsiveness of a photoreceptor is governed by the charge-transporting layer, in particular, by the charge-transporting material, it is known that the responsiveness changes considerably with the binder resin.

Many charge-transporting substances of various kinds have been proposed as measures in improving photoreceptor sensitivity, reducing residual potential, and improving responsiveness. For example, patent document 1 includes a statement to the effect that by incorporating a specific charge-transporting substance into a photosensitive layer, the photoreceptor is caused to have high sensitivity, low residual potential, and high mobility.

With respect to durability improvement in photoreceptors, polycarbonate resins have been frequently used hitherto as binder resins for surface layers of electrophotographic photoreceptors. In recent years, however, it has been proposed to use a polyarylate resin, which has higher mechanical strength than the polycarbonate resins, to thereby satisfactorily improve the durability of an electrophotographic photoreceptor (patent document 2).

Furthermore, it is known that by incorporating a polyarylate resin obtained by copolymerizing a diphenyl ether-4,4'-dicarboxylic acid residue having a specific structure with a divalent phenol residue having a specific structure into a photosensitive layer, the photoreceptor is rendered highly excellent in mechanical strength, in particular, wearing resistance (see, for example, patent document 3).

Patent Document 1: JP-A-10-312072
Patent Document 2: JP-A-10-039521
Patent Document 3: JP-A-2006-53549

DISCLOSURE OF THE INVENTION

Problems that the Invention is to Solve

However, photosensitive layers containing the polyarylate resin disclosed in patent document 3 and further containing the charge-transporting substance disclosed in patent document 1 have not yet given satisfactory results concerning photosensitivity, residual potential, and mobility, although excellent in durability improvement. In addition, there has been a more serious problem. That is, it is difficult to select a charge-transporting material in forming a photosensitive layer containing the polyarylate resin and it has been exceedingly difficult to impart sufficient electrical properties to the layer.

The invention has been achieved in order to overcome those problems. Namely, an object of the invention is to provide electrophotographic photoreceptors which have excellent abrasion resistance under practical load, have high mechanical strength, and further have highly satisfactory electrical properties. Another object is to provide an electrophotographic photoreceptor cartridge and an image-forming apparatus each having such an electrophotographic photoreceptor.

Means for Solving the Problems

The present inventors diligently made investigations. As a result, they have found that by incorporating a polyarylate resin having a specific structure into a photosensitive layer, this photosensitive layer is caused to have sufficient mechanical properties and that a charge-transporting material having exceedingly satisfactory compatibility concerning electrical properties with the polyarylate resin is a charge-transporting material having an enamine structure. The invention, which is described below, has been thus completed.

The invention provides, according to a first aspect thereof, an electrophotographic photoreceptor comprising a conductive substrate and a photosensitive layer formed thereover, wherein the photosensitive layer contains at least a polyarylate resin having a repeating structure represented by the following formula [1] and a compound represented by the following formula [6].

[Chem. 1]

[1]

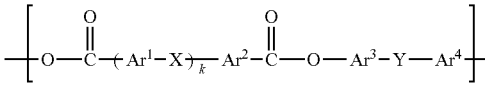

(In formula [1], $Ar^1$ to $Ar^4$ each independently represent an arylene group which may have a substituent; X is a single bond, an oxygen atom, a sulfur atom, a group represented by the following formula [2], or a group represented by the following formula [3]; $R^3$ and $R^2$ in formula [2] each independently represent a hydrogen atom, an alkyl group, or an aryl group, provided that $R^1$ and $R^2$ may be bonded to each other to form a ring; $R^3$ in formula [3] represents an alkylene group, an arylene group, or a group represented by the following formula [4]; $R^4$ and $R^5$ in formula [4] each independently represent an alkylene group; and $Ar^5$ represents an arylene group. Symbol k represents an integer of 0 to 5, provided that when k=0, either $Ar^3$ or $Ar^4$ is an arylene group having a substituent.

In formula [1], Y is a single bond, an oxygen atom, a sulfur atom, or a group represented by the following formula [5], wherein $R^6$ and $R^7$ each independently represent a hydrogen atom, an alkyl group, an alkoxy group, or an aryl group, provided that $R^6$ and $R^7$ may be bonded to each other to form a ring.)

[Chem. 2]

[2]

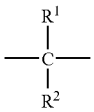

[Chem. 3]

[3]

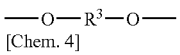

[Chem. 4]

[4]

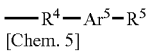

[Chem. 5]

-continued

[5]

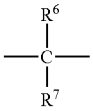

[Chem. 6]

[6]

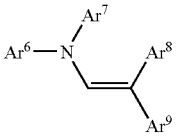

(In formula [6], $Ar^6$ to $Ar^9$ may be the same or different and each represent an aryl group which may have a substituent.)

In the first aspect of the invention, X in formula [1] preferably is an oxygen atom, a sulfur atom, a group represented by formula [2], or a group represented by formula [3].

In the first aspect of the invention, the compound represented by formula [6] preferably is a compound specified by the following formula [7].

[Chem. 7]

[7]

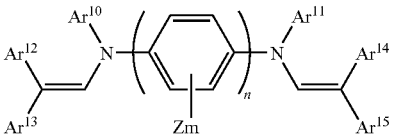

(In formula [7], $Ar^{10}$ to $Ar^{15}$ may be the same or different and each represent an aryl group which may have a substituent; n represents an integer of 2 or larger; Z represents a monovalent organic residue; and m represents an integer of 0 to 4.)

The invention provides, according to a second aspect thereof, an electrophotographic photoreceptor comprising a conductive substrate and a photosensitive layer formed thereover, wherein the photosensitive layer contains at least a polyarylate resin and a charge-transporting substance, the charge-transporting substance has a HOMO energy level E_homo satisfying the following expression:

$$E_homo > -4.67\ (eV),$$

the HOMO energy level being obtained through the calculation of structural optimization using density functional calculation B3LYP/6-31G(d,p), and the charge-transporting substance, in a stable structure obtained through the calculation of structural optimization using B3LYP/6-31G(d,p), has a calculated value αcal of polarizability α satisfying the following expression:

$$\alpha cal > 70\ (Å^3),$$

the calculated value αcal being obtained through a calculation by the restricted Hartree-Fock method (basis function: 6-31 G(d,p); hereinafter, this calculation is referred to as HF/6-31G(d,p)).

In the second aspect of the invention, the polyarylate resin preferably is a polyarylate resin having a repeating structure represented by formula [1] given above.

The invention provides, according to a third aspect thereof, an electrophotographic photoreceptor comprising a conductive substrate and a photosensitive layer formed thereover, wherein the photosensitive layer contains at least one compound represented by the following formula [7].

[Chem. 8]

[7']

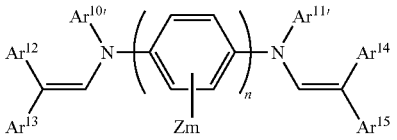

(In general formula [7'], $Ar^{10'}$, $Ar^{11'}$, and $Ar^{12}$ to $Ar^{15}$ may be the same or different and each represent an aryl group which may have a substituent; n represents an integer of 2 or larger; Z represents a monovalent organic residue; and m represents an integer of 0 to 4; provided that at least one of $Ar^{10'}$ and $Ar^{11'}$ is an aryl group having a substituent.)

In the third aspect of the invention, m preferably is 0.

In the first to the third aspects of the invention, it is preferred that the photosensitive layer should comprise a charge-generating layer and a charge-transporting layer, the charge-generating layer and the charge-transporting layer having been laminated in this order over the conductive substrate.

The invention provides, according to a fourth aspect thereof, an electrophotographic cartridge comprising the electrophotographic photoreceptor according to any one of the first to the third aspects of the invention and at least one member selected from a charging device which charges the electrophotographic photoreceptor, an imagewise-exposure device which imagewise exposes the charged electrophotographic photoreceptor to light to form an electrostatic latent image, a developing device which develops the electrostatic latent image with a toner, a transfer device which transfers the toner to a receiving object, a fixing device which fixes the toner transferred to the receiving object, and a cleaner which recovers the toner remaining adherent to the electrophotographic photoreceptor.

The invention provides, according to a fifth aspect thereof, an image-forming apparatus comprising the electrophotographic photoreceptor according to any one of the first to the third aspects of the invention, a charging device which charges the electrophotographic photoreceptor, an exposure device which exposes the charged electrophotographic photoreceptor to light to form an electrostatic latent image, a developing device which develops the electrostatic latent image with a toner, and a transfer device which transfers the toner to a receiving object.

Advantages of the Invention

According to the first to the third aspects of the invention, electrophotographic photoreceptors having excellent wearing resistance and highly excellent in responsiveness, electrical properties, or repeatability can be obtained.

DESCRIPTION OF THE REFERENCE NUMERALS AND SIGNS

Figure 1:
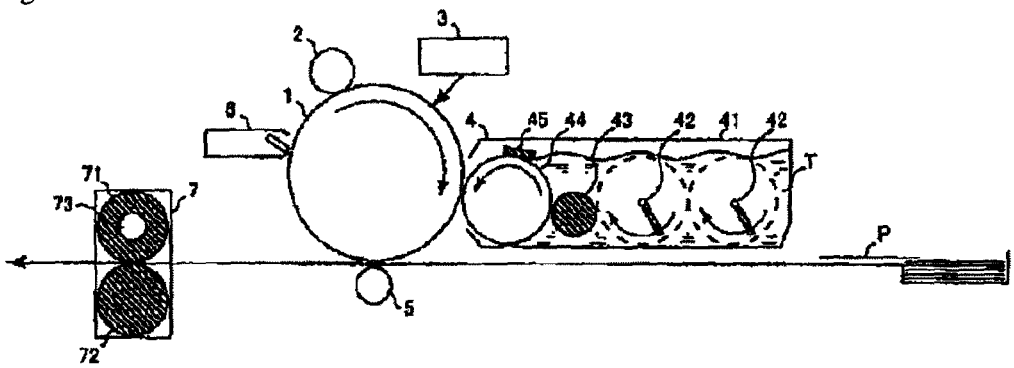
FIG. 1 is a diagrammatic view illustrating one embodiment of the image-forming apparatus employing an electrophotographic photoreceptor of the invention.

1 Photoreceptor
2 Charging device (charging roller)
3 Exposure device
4 Developing device
5 Transfer device
6 Cleaner
7 Fixing device
41 Developing vessel
42 Agitator
43 Feed roller
44 Developing roller
45 Control member
71 Upper fixing member (pressure roller)
72 Lower fixing member (fixing roller)
73 Heater
T Toner
P Recording paper

BEST MODE FOR CARRYING OUT THE INVENTION

Best modes for carrying out the invention will be explained below in detail. The invention should not be construed as being limited to the following embodiments, and various modifications of the invention can be made within the spirit of the invention.

[Electrophotographic Photoreceptors]

The electrophotographic photoreceptor of the first aspect of the invention includes a conductive substrate and at least a photosensitive layer formed thereover. This photosensitive layer contains a polyarylate resin having a repeating structure represented by the following general formula [1] and further contains an enamine compound represented by general formula [6]. The polyarylate resin contained in the photosensitive layer is used as a binder resin, while the enamine compound is used as a charge-transporting material.

[Chem. 9]

[1]

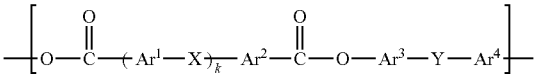

In formula [1], $Ar^1$ to $Ar^4$ each independently represents an arylene group which may have a substituent, and k is an integer of 0 to 5, provided that when k=0, either $Ar^3$ or $Ar^4$ is an arylene group having a substituent.

In formula [1], X represents a single bond, an oxygen atom, a sulfur atom, or a bivalent organic residue having a structure represented by the following formula [2] or formula [3].

[Chem. 10]

[2]

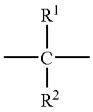

($R^1$ and $R^2$ in formula [2] each independently represent a hydrogen atom, an alkyl group, or an aryl group, or represent a cycloalkylidene group formed by the $R^1$ and $R^2$ bonded to each other.)

[Chem. 11]

$$—O—R^3—O—$$ [3]

($R^3$ in formula [3] represents an alkylene group, an arylene group, or a group represented by the following formula [4].)

[Chem. 12]

$$—R^4—Ar^5—R^5— \quad [4]$$

($R^4$ and $R^5$ in formula [4] each independently represent an alkylene group, and $Ar^5$ represents an arylene group.)

In formula [1], Y represents a single bond, an oxygen atom, a sulfur atom, or a bivalent organic residue having a structure represented by the following formula [5].

[Chem. 13]

[5]

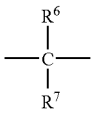

(In formula [5], $R^6$ and $R^7$ each independently represent a hydrogen atom, an alkyl group, an alkoxy group, or an aryl group, or represent a cycloalkylidene group formed by the $R^6$ and $R^7$ bonded to each other.)

[Chem. 14]

[6]

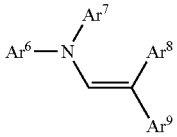

In formula [6], $Ar^6$ to $Ar^9$ may be the same or different and each represent an aryl group which may have a substituent.

It is especially preferred that the enamine compound should be a compound represented by the following formula [7].

[Chem.15]

[7]

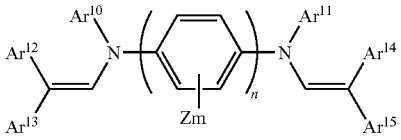

(In formula [7], $Ar^{10}$ to $Ar^{15}$ may be the same or different and each represent an aryl group which may have a substituent; n represents an integer of 2 or larger; Z represents a monovalent organic residue; and m represents an integer of 0 to 4.)

The electrophotographic photoreceptor of the second aspect of the invention includes a conductive substrate and a photosensitive layer formed thereover, and is characterized in that the photosensitive layer contains at least a polyarylate resin and a charge-transporting substance, that the charge-transporting substance has a HOMO energy level E_homo satisfying the following expression:

$$E_homo > -4.67 \text{ (eV)},$$

the HOMO energy level being obtained through the calculation of structural optimization using density functional calculation B3LYP/6-31G(d,p), and that the stable structure obtained through the calculation of structural optimization using B3LYP/6-31G(d,p) has a calculated value αcal of polarizability α satisfying the following expression:

$$\alpha cal > 70 \text{ (Å}^3\text{)},$$

the calculated value αcal being obtained through a calculation by the restricted Hartree-Fock method (basis function: 6-31G(d,p); hereinafter, this calculation is referred to as HF/6-31G(d,p)).

In the second aspect of the invention, the polyarylate resin preferably is a polyarylate resin having a repeating structure represented by formula [1].

The electrophotographic photoreceptor of the third aspect of the invention includes a conductive substrate and a photosensitive layer formed thereover, wherein the photosensitive layer contains at least one compound represented by the following formula [7'].

[Chem. 16]

[7']

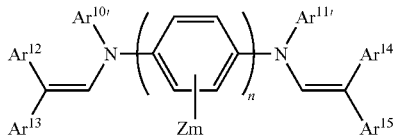

(In general formula [7'], $Ar^{10'}$, $Ar^{11'}$, and $Ar^{12}$ to $Ar^{15}$ may be the same or different and each represent an aryl group which may have a substituent; n represents an integer of 2 or larger; Z represents a monovalent organic residue; and m represents an integer of 0 to 4; provided that at least one of $Ar^{10'}$ and $Ar^{11'}$ is an aryl group having a substituent.)

In the third aspect of the invention, m preferably is 0.

With respect to the specific constitution of the photosensitive layers, representative examples thereof include: a multilayer type photosensitive layer formed by superposing, on a conductive substrate, a charge-generating layer including a charge-generating material as a main component and a charge-transporting layer including a charge-transporting material and a binder resin as main components; and a dispersion type (single-layer type) photosensitive layer which is a layer formed on a conductive substrate and which includes a charge-transporting material and a binder resin and contains a charge-generating material dispersed therein. In the invention, the polyarylate resin represented by general formula [1] described above and the enamine compound represented by general formula [6], [7], or [7'] described above are used usually in the same layer which is a component of the photosensitive layer, and are used preferably in the charge-transporting layer as a component of the multilayer type photosensitive layer.

(Polyarylate Resin)

The polyarylate resin is explained first. The polyarylate resin contained in each photosensitive layer includes a repeating structure represented by general formula [1]. This resin can be produced by a known method, for example, from a bivalent hydroxyaryl ingredient and a dicarboxylic acid ingredient.

In general formula [1], $Ar^1$ to $Ar^4$ may be the same or different and each independently represent an arylene group which may have a substituent. Although the arylene group is not particularly limited, an arylene group having 6-20 carbon atoms is preferred. Examples thereof include phenylene, naphthylene, anthrylene, phenanthrylene, and pyrenylene. Of these, phenylene and naphthylene are especially preferred from the standpoint of production cost. When phenylene is compared with naphthylene, phenylene is more preferred from the standpoints of both production cost and ease of synthesis. It is, however, noted that when k in formula [1] is 0, either $Ar^3$ or $Ar^4$ is an arylene group having a substituent. This is because in case where both $Ar^3$ and $Ar^4$ are unsubstituted arylene groups when k=0, the photosensitive layer has poor adhesiveness.

The substituents which each may be independently possessed by the arylene groups are not particularly limited. Preferred examples thereof include a hydrogen atom, alkyl groups, alkoxy groups, aryl groups, fused-ring groups, and halogen radicals. When the mechanical properties of the binder resin for the photosensitive layer and the solubility thereof in coating fluids for photosensitive-layer formation are taken into account, preferred substituents are as follows. Preferred of the aryl groups are phenyl and naphthyl. Preferred of the halogen radicals are fluorine, chlorine, bromine, and iodine atoms. Preferred of the alkoxy groups are methoxy, ethoxy, and butoxy. Preferred of the alkyl groups are alkyl groups having 1-10 carbon atoms. More preferred are alkyl groups having 1-8 carbon atoms. Especially preferred are the alkyl group having 1 or 2 carbon atoms. Specifically, methyl is the most preferred. The number of substituents of each of $Ar^1$ to $Ar^4$ is not particularly limited. However, the number thereof is preferably 3 or smaller, more preferably 2 or smaller, especially preferably 1 or smaller.

In general formula [1], $Ar^1$ and $Ar^2$ preferably are arylene groups which are the same and have the same substituent(s). It is especially preferred that $Ar^1$ and $Ar^2$ each should be unsubstituted phenylene. It is preferred that $Ar^3$ and $Ar^4$ also should be the same arylene group. Especially preferably, $Ar^3$ and $Ar^4$ each are phenylene having one or more methyl groups.

In general formula [1], X represents a single bond, an oxygen atom, a sulfur atom, or a bivalent organic residue having either a structure represented by formula [2] or a structure represented by formula [3]. $R^1$ and $R^2$ in formula [2] each independently represent a hydrogen atom, an alkyl group, or an aryl group, or represent a cycloalkylidene group formed by the R' and $R^2$ bonded to each other. Examples of the alkyl groups represented by $R^1$ and $R^2$ in formula [2] include methyl, ethyl, propyl, and butyl. Examples of the aryl groups include phenyl and naphthyl. Examples of the cycloalkylidene group formed by the $R^1$ and $R^2$ in formula [2] bonded to each other include cyclopentylidene, cyclohexylidene, and cycloheptylidene. $R^3$ in formula [3] represents an alkylene group, an arylene group, or a group represented by formula [4]. Examples of the alkylene group represented by $R^3$ in formula [3] include methylene, ethylene, and propylene. Examples of the arylene group represented by $R^3$ in formula [3] include phenylene and terphenylene. Examples of the group represented by formula [4] include the group represented by the following formula [8]. From the standpoint of wearing resistance, it is preferred that X should be an oxygen atom among those.

[Chem. 17]

[8]

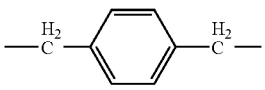

In general formula [1], k is an integer of 0 to 5. However, k preferably is an integer of 0 or 1, and is most preferably 1 from the standpoint of wearing resistance.

In general formula [1], Y represents a single bond, a sulfur atom, an oxygen atom, or a bivalent organic residue having a structure represented by formula [5]. $R^6$ and $R^7$ in formula [5] each independently represent a hydrogen atom, an alkyl group, an alkoxy group, or an aryl group, or represent a cycloalkylidene group formed by the $R^6$ and $R^7$ bonded to each other. When the mechanical properties of the binder resin for the photosensitive layer and the solubility thereof in coating fluids for photosensitive-layer formation are taken into account, preferred examples of $R^6$ and $R^7$ include the following. The aryl group preferably is phenyl or naphthyl, and the alkoxy group preferably is methoxy, ethoxy, or butoxy. The alkyl group preferably is an alkyl group having 1-10 carbon atoms, more preferably having 1-8 carbon atoms, especially preferably having 1-2 carbon atoms. When the ease of production of the bivalent hydroxyaryl ingredient to be used for producing the polyarylate resin is taken into account, Y is preferably a single bond, —O—, —S—, $—CH_2—$, $—CH(CH_3)—$, $—C(CH_3)_2—$, or cyclohexylidene, more preferably $—CH_2—$, $—CH(CH_3)—$, $—C(CH_3)_2—$, or cyclohexylidene, especially preferably $—CH_2—$ or $—CH(CH_3)—$.

In the invention, it is preferred that the polyarylate resin should be a polyarylate resin including a repeating structure represented by the following general formula [9]. In general formula [9], $Ar^{16}$ to $Ar^{19}$ each independently represent an arylene group which may have a substituent, and $R^8$ represents a hydrogen atom or an alkyl group.

[Chem. 18]

[9]

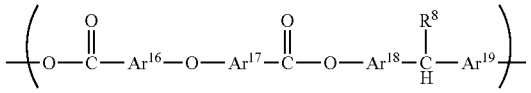

In general formula [9], $Ar^{16}$ to $Ar^{19}$, which respectively correspond to the $Ar^1$ to $Ar^4$ described above, each especially preferably are phenylene which may have a substituent. The substituents preferably are a hydrogen atom or an alkyl group, and especially preferably are methyl. It is especially preferred that in general formula [9], $Ar^{18}$ and $Ar^{19}$ should be the same phenylene group having one or more methyl groups and $Ar^{16}$ and $Ar^{17}$ should be phenylene having no substituent. $R^8$ represents a hydrogen atom or an alkyl group, and this alkyl group has preferably 1-10 carbon atoms, more preferably 1-8 carbon atoms, and is especially preferably methyl.

The bivalent hydroxyaryl ingredient, which becomes the bivalent hydroxyaryl residue to be contained in the polyarylate resin, is represented by the following general formula [10]. This ingredient is preferably represented by the following general formula [11].

[Chem. 19]

[10]

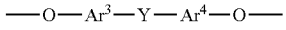

$Ar^3$, $Ar^4$, and Y in general formula [10] are as described above.

[Chem. 20]

[11]

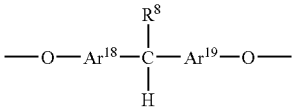

$Ar^{18}$ and $Ar^{19}$ in general formula [11] each independently represent phenylene which may have a substituent. $R^8$ represents a hydrogen atom or methyl.

Specifically, in the case where $R^8$ in general formula [11] is a hydrogen atom, examples of the bivalent hydroxyaryl ingredient represented by general formula [11] include bis(2-hydroxyphenyl)methane, (2-hydroxyphenyl)(3-hydroxyphenyl)methane, (2-hydroxyphenyl)(4-hydroxyphenyl)methane, bis(3-hydroxyphenyl)methane, (3-hydroxyphenyl)(4-hydroxyphenyl)methane, bis(4-hydroxyphenyl)methane, bis(2-hydroxy-3-methylphenyl)methane, bis(2-hydroxy-3-ethylphenyl)methane, (2-hydroxy-3-methylphenyl)(3-hydroxy-4-methylphenyl)methane, (2-hydroxy-3-ethylphenyl)(3-hydroxy-4-ethylphenyl)methane, (2-hydroxy-3-methylphenyl)(4-hydroxy-3-methylphenyl)methane, (2-hydroxy-3-ethylphenyl)(4-hydroxy-3-ethylphenyl)methane, bis(3-hydroxy-4-methylphenyl)methane, bis(3-hydroxy-4-ethylphenyl)methane, (3-hydroxy-4-methylphenyl)(4-hydroxy-3-methylphenyl)methane, (3-hydroxy-4-ethylphenyl)(4-hydroxy-3-ethylphenyl)methane, bis(4-hydroxy-3-methylphenyl)methane, and bis(4-hydroxy-3-ethylphenyl)methane. In the case where $R^8$ is methyl, examples of the ingredient include 1,1-bis(2-hydroxyphenyl)ethane, 1-(2-hydroxyphenyl)-1-(3-hydroxyphenyl)ethane, 1-(2-hydroxyphenyl)-1-(4-hydroxyphenyl)ethane, 1,1-bis(3-hydroxyphenyl)ethane, 1-(3-hydroxyphenyl)-1-(4-hydroxyphenyl)ethane, 1,1-bis(4-hydroxyphenyl)ethane, 1,1-bis(2-hydroxy-3-methylphenyl)ethane, 1,1-bis(2-hydroxy-3-ethylphenyl)ethane, 1-(2-hydroxy-3-methylphenyl)-1-(3-hydroxy-4-methylphenyl)ethane, 1-(2-hydroxy-3-ethylphenyl)-1-(3-hydroxy-4-ethylphenyl)ethane, 1-(2-hydroxy-3-methylphenyl)-1-(4-hydroxy-3-methylphenyl)ethane, 1-(2-hydroxy-3-ethylphenyl)-1-(4-hydroxy-3-ethylphenyl)ethane, 1,1-bis(3-hydroxy-4-methylphenyl)ethane, 1,1-bis(3-hydroxy-4-ethylphenyl)ethane, 1-(3-hydroxy-4-methylphenyl)-1-(4-hydroxy-3-methylphenyl)ethane, 1-(3-hydroxy-4-ethylphenyl)-1-(4-hydroxy-3-ethylphenyl)ethane, 1,1-bis(4-hydroxy-3-methylphenyl)ethane, and 1,1-bis(4-hydroxy-3-ethylphenyl)ethane.

Of these, the following are preferred. In the case where $R^8$ in general formula [11] is a hydrogen atom, especially preferred examples are bis(4-hydroxyphenyl)methane, (2-hydroxyphenyl)(4-hydroxyphenyl)methane, bis(2-hydroxyphenyl)methane, bis(4-hydroxy-3-methylphenyl)methane, and bis(4-hydroxy-3-ethylphenyl)methane from the standpoint of the ease of production of the bivalent hydroxyaryl ingredient. Two or more of these bivalent hydroxyaryl ingredients can be used in combination.

In the case where $R^8$ in general formula [11] is methyl, especially preferred examples are 1,1-bis(4-hydroxyphenyl)ethane, 1-(2-hydroxyphenyl)-1-(4-hydroxyphenyl)ethane, 1,1-bis(2-hydroxyphenyl)ethane, 1,1-bis(4-hydroxy-3-methylphenyl)ethane, and 1,1-bis(4-hydroxy-3-ethylphenyl)ethane. Two or more of these bivalent hydroxyaryl ingredients can be used in combination.

Although general formula [11] is included in general formula [10], an explanation is given below on compounds of general formula [10] other than those compounds of general formula [11] shown above as examples.

Examples of the bivalent hydroxyaryl ingredient represented by general formula [10] include 3,3',5,5'-tetramethyl-4,4'-dihydroxybiphenyl, 2,4,3',5'-tetramethyl-3,4'-dihydroxybiphenyl, 2,2',4,4'-tetramethyl-3,3'-dihydroxybiphenyl, bis(4-hydroxy-3,5-dimethylphenyl)ether, 4-hydroxy-3,5-dimethylphenyl 3-hydroxy-2,4-dimethylphenyl ether, bis(3-hydroxy-2,4-dimethylphenyl)ether, bis(4-hydroxy-3,5-dimethylphenyl)methane, (4-hydroxy-3,5-dimethylphenyl)(3-hydroxy-2,4-dimethylphenyl)methane, bis(3-hydroxy-2,4-dimethylphenyl)methane, 1,1-bis(4-hydroxy-3,5-dimethylphenyl)ethane, 1-(4-hydroxy-3,5-dimethylphenyl)-1-(3-hydroxy-2,4-dimethylphenyl)ethane, 1,1-bis(3-hydroxy-2,4-dimethylphenyl)ethane, 2,2-bis(4-hydroxy-3,5-dimethylphenyl)propane, 2-(4-hydroxy-3,5-dimethylphenyl)-2-(3-hydroxy-2,4-dimethylphenyl)propane, 2,2-bis(3-hydroxy-2,4-dimethylphenyl)propane, 1,1-bis(4-hydroxy-3,5-dimethylphenyl)cyclohexane, 1-(4-hydroxy-3,5-dimethylphenyl)-1-(3-hydroxy-2,4-dimethylphenyl)cyclohexane, and 1,1-bis(3-hydroxy-2,4-dimethylphenyl)cyclohexane. Preferred are 3,3',5,5'-tetramethyl-4,4'-dihydroxybiphenyl, bis(4-hydroxy-3,5-dimethylphenyl)ether, bis(4-hydroxy-3,5-dimethylphenyl)methane, 1,1-bis(4-hydroxy-3,5-dimethyphenyl)ethane, 2,2-bis(4-hydroxy-3,5-dimethylphenyl)propane, and 1,1-bis(4-hydroxy-3,5-dimethylphenyl)cyclohexane.

Examples thereof further include bis(2-hydroxyphenyl)ether, (2-hydroxyphenyl) (3-hydroxyphenyl)ether, (2-hydroxyphenyl) (4-hydroxyphenyl)ether, bis(3-hydroxyphenyl)ether, (3-hydroxyphenyl) (4-hydroxyphenyl)ether, bis(4-hydroxyphenyl)ether, bis(2-hydroxy-3-methylphenyl)ether, bis(2-hydroxy-3-ethylphenyl)ether, (2-hydroxy-3-methylphenyl) (3-hydroxy-4-methylphenyl)ether, (2-hydroxy-3-ethylphenyl) (3-hydroxy-4-ethylphenyl)ether, (2-hydroxy-3-methylphenyl) (4-hydroxy-3-methylphenyl)ether, (2-hydroxy-3-ethylphenyl) (4-hydroxy-3-ethylphenyl)ether, bis(3-hydroxy-4-methylphenyl)ether, bis(3-hydroxy-4-ethylphenyl)ether, (3-hydroxy-4-methylphenyl) (4-hydroxy-3-methylphenyl)ether, (3-hydroxy-4-ethylphenyl) (4-hydroxy-3-ethylphenyl)ether, bis(4-hydroxy-3-methylphenyl)ether, and bis(4-hydroxy-3-ethylphenyl)ether. Examples thereof furthermore include bis(4-hydroxyphenyl)methane, (2-hydroxyphenyl)(4-hydroxyphenyl)methane, bis(2-hydroxyphenyl)methane, 1,1-bis(4-hydroxyphenyl)ethane, 2,2-bis(4-hydroxyphenyl)propane, 1,1-bis(4-hydroxyphenyl)cyclohexane, bis(4-hydroxyphenyl)ketone, bis(4-hydroxyphenyl)ether, bis(4-hydroxy-3-methylphenyl)methane, 1,1-bis(4-hydroxy-3-methylphenyl)ethane, 2,2-bis(4-hydroxy-3-methylphenyl)propane, 1,1-bis(4-hydroxy-3-methylphenyl)cyclohexane, bis(4-hydroxy-3-methylphenyl)ether, bis(4-hydroxy-3,5-dimethylphenyl)methane, 1,1-bis(4-hydroxy-3,5-dimethylphenyl)ethane, 2,2-bis(4-hydroxy-3,5-dimethylphenyl)propane, 1,1-bis(4-hydroxy-3,5-dimethylphenyl)cyclohexane, bis(4-hydroxy-2,3,5-trimethylphenyl)phenylmethane, 1,1-bis(4-hydroxy-2,3,5-trimethylphenyl)phenylethane, bis(4-hydroxyphenyl)-1-phenylmethane, 1,1-bis(4-hydroxyphenyl)-1-phenylethane, 1,1-bis(4-hydroxyphenyl)-1-phenylpropane, bis(4-hydroxyphenyl)diphenylmethane, bis(4-hydroxyphenyl)diphenylmethane, bis(4-hydroxyphenyl)methoxymethane, 1,1-bis(4-hydroxyphenyl)-1-methoxyethane, 1,1-bis(4-hydroxyphenyl)-1-methoxypropane, and bis(4-hydroxyphenyl)dimethoxymethane.

Especially preferred of these, from the standpoint of the ease of production of the bivalent hydroxyaryl ingredient, are bis(4-hydroxy-3,5-dimethylphenyl)methane, 2,2-bis(4-hydroxy-3,5-dimethylphenyl)propane, 1,1-bis(4-hydroxy-3,5-dimethylphenyl)cyclohexane, bis(4-hydroxyphenyl)ether, (2-hydroxyphenyl) (4-hydroxyphenyl)ether, bis(2-hydroxyphenyl)ether, bis(4-hydroxy-3-methylphenyl)ether, and bis(4-hydroxy-3-ethylphenyl)ether. Two or more of these bivalent hydroxyaryl ingredients can be used in combination.

The dicarboxylic acid ingredient serving as a dicarboxylic acid residue in the polyarylate resin is represented by the following general formula [12].

[Chem. 21]

[12]

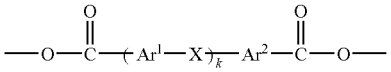

$Ar^1$, $Ar^2$, X, and k in general formula [12] are as described above. Examples of the dicarboxylic acid residue included in formula [12] include structures represented by the following general formulae [I] to [VI]. Preferably, the residue is represented by the following general formula [13].

[Chem. 22]

[I]

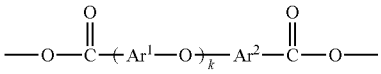

[Chem. 23]

[II]

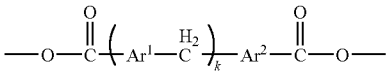

[Chem. 24]

[III]

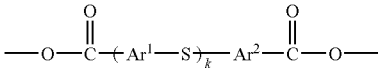

[Chem. 25]

[IV]

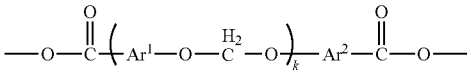

[Chem. 26]

[V]

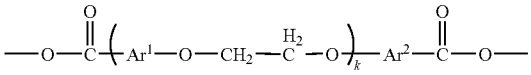

[Chem. 27]

[VI]

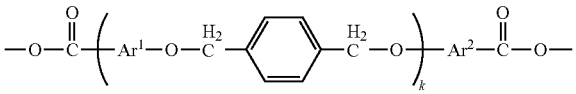

[Chem. 28]

[13]

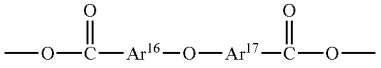

$Ar^{16}$ and $Ar^{17}$ in general formula [13] also are as described above. Preferably, however, $Ar^{16}$ and $Ar^{17}$ each are phenylene which may have a substituent.

Preferred examples of the dicarboxylic acid residue include a diphenyl ether-2,2'-dicarboxylic acid residue, diphenyl ether-2,3'-dicarboxylic acid residue, diphenyl ether-2,4'-dicarboxylic acid residue, diphenyl ether-3,3'-dicarboxylic acid residue, diphenyl ether-3,4'-dicarboxylic acid residue, and diphenyl ether-4,4'-dicarboxylic acid residue. More preferred of these, from the standpoint of the ease of production of the dicarboxylic acid ingredient, are a diphenyl ether-2,2'-dicarboxylic acid residue, diphenyl ether-2,4'-dicarboxylic acid residue, and diphenyl ether-4,4'-dicarboxylic acid residue. Especially preferred is a diphenyl ether-4,4'-dicarboxylic acid residue.

The polyarylate resin may be a resin which contains other dicarboxylic acid ingredient(s) and includes general formula [1] as part of the structure thereof. Examples of residues of the other dicarboxylic acids include an adipic acid residue, suberic acid residue, sebacic acid residue, phthalic acid residue, isophthalic acid residue, terephthalic acid residue, toluene-2,5-dicarboxylic acid residue, p-xylene-2,5-dicarboxylic acid residue, pyridine-2,3-dicarboxlyic acid residue, pyridine-2,4-dicarboxlyic acid residue, pyridine-2,5-dicarboxlyic acid residue, pyridine-2,6-dicarboxlyic acid residue, pyridine-3,4-dicarboxlyic acid residue, pyridine-3,5-dicarboxlyic acid residue, naphthalene-1,4-dicarboxylic acid residue, naphthalene-2,3-dicarboxylic acid residue, naphthalene-2,6-dicarboxylic acid residue, biphenyl-2,2'-dicarboxylic acid residue, and biphenyl-4,4'-dicarboxylic acid residue. Preferred are an adipic acid residue, sebacic acid residue, phthalic acid residue, isophthalic acid residue, terephthalic acid residue, naphthalene-1,4-dicarboxylic acid residue, naphthalene-2,6-dicarboxylic acid residue, biphenyl-2,2'-dicarboxylic acid residue, and biphenyl-4,4'-dicarboxylic acid residue. Especially preferred are an isophthalic acid residue and a terephthalic acid residue. Two or more of these dicarboxylic acid residues can be used in combination.

In the case where the polyarylate resin has both a dicarboxylic acid residue of general formula [12] and the other dicarboxylic acid residue(s) described above, the proportion of the dicarboxylic acid residue of general formula [12] is preferably 70% or higher, more preferably 80% or higher, especially preferably 90% or higher, in terms of the proportion by number of repeating units. Most preferred is the case where the polyarylate resin has one or more dicarboxylic acid residues of general formula [12] as the only dicarboxylic acid residue(s). Namely, the most preferred is the case where the proportion of dicarboxylic acid residues of general formula [12] is 100% in terms of the proportion by number of repeating units.

The polyarylate resin constituting the invention can be used as a mixture thereof with another resin in an electrophotographic photoreceptor. Examples of the resin optionally usable in combination with the polyarylate resin include thermoplastic resins and various thermosetting resins, such as vinyl polymers, e.g., poly(methyl methacrylate), polystyrene, and poly(vinyl chloride), copolymers thereof, polycarbonates, polyarylates, polyarylate polycarbonates, polysulfones, phenoxies, epoxies, and silicone resins. Preferred of these resins are polycarbonate resins.

The proportion in which such an optionally usable resin is mixed is not particularly limited. However, for sufficiently obtaining the effects of the invention, it is preferred to use the resin in such an amount that the proportion thereof does not exceed the proportion of the polyarylate resin according to the invention. It is especially preferred that the polyarylate resin should not be used in combination with any other resin.

In the polyarylate resin including a repeating structure represented by general formula [1] or [9], the viscosity-average molecular weight in each case is generally 10,000 or higher, preferably 15,000 or higher, more preferably 20,000 or higher, and is generally 300,000 or lower, preferably 200,000 or lower, more preferably 100,000 or lower, so that the resin is suitable for forming a photosensitive layer through coating fluid application. In case where the viscosity-average molecular weight thereof is lower than 10,000, this resin has reduced mechanical strength and is impracticable. In case where the viscosity-average molecular weight thereof exceeds 300,000, it is difficult to form a photosensitive layer having an appropriate thickness through coating fluid application.

The polyarylate resin described above is used in electrophotographic photoreceptors. The resin is used as a binder resin in the photosensitive layer to be formed over a conductive substrate for the photoreceptors.

(Enamine Compound)

The enamine compound is explained next. The enamine compound contained in the photosensitive layer of an electrophotographic photoreceptor in the invention is a charge-transporting material represented by the following formula [6].

[Chem. 29]

[6]

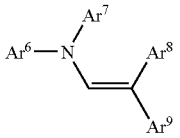

(In formula [6], $Ar^6$ to $Ar^9$ may be the same or different and each represent an aryl group which may have a substituent.)

In general formula [6], $Ar^6$ to $Ar^9$ preferably are aryl groups having 6-20 carbon atoms, and these aryl groups may be the same or different. Examples thereof include phenyl, naphthyl, fluorenyl, anthryl, phenanthryl, and pyrenyl. Especially preferred from the standpoint of production cost are aryl groups having 6-10 carbon atoms, such as phenyl and naphthyl. In the case where the aryl groups have substituents, it is preferred that the substituents each should be a substituent having a substituent constant $\sigma_p$ in Hammett's rule of 0.20 or smaller.

Hammett's rule is a rule of thumb which is used for explaining the effect of a substituent of an aromatic compound on the state of electrons of the aromatic ring. Substituent constants $\sigma_p$ for substituted benzenes can be regarded as quantified values indicating the degrees of electron donation/attraction of the substituents. When a substituted benzoic acid has a positive value of $\sigma_p$, this substituted acid has higher acidity than the unsubstituted acid, i.e., the substituent serves as an electron-attracting substituent. Conversely, when the value of $\sigma_p$ is negative, the substituent serves as an electron-donating substituent. Table 1 summarizes the $\sigma_p$ values of representative substituents (The Chemical Society of Japan, ed., *Kagaku Binran Kiso-hen II Kaitei 4-han*, Maruzen Co., Ltd., published on Sep. 30, 1993, pp.364-365).

TABLE 1

Substituent constants σ in Hammett's rule

| Substituent | $\sigma_p$ | Substituent | $\sigma_p$ |
|---|---|---|---|
| —$NMe_2$ | −0.83 | —CH═$CH_2$ | −0.08 |
| —OMe | −0.268 | —F | 0.06 |
| -$^t$Bu | −0.197 | —Cl | 0.227 |
| -$^i$Pr | −0.156 | —Br | 0.232 |

TABLE 1-continued

Substituent constants σ in Hammett's rule

| Substituent | $\sigma_p$ | Substituent | $\sigma_p$ |
|---|---|---|---|
| -Et | −0.151 | —COMe | 0.491 |
| -Me | −0.170 | —$CF_3$ | 0.505 |
| —H (reference) | 0.00 | —CN | 0.670 |
| -Ph | 0.01 | —$NO_2$ | 0.78 |
| -β-Naphthyl | 0.062 | —$CO_2Et$ | 0.453 |

It is preferred that the charge-transporting material should be a compound represented by the following formula [7].

[Chem. 30]

[7]

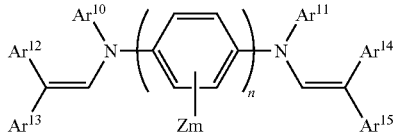

(In formula [7], $Ar^{10}$ to $Ar^{15}$ may be the same or different and each represent an aryl group which may have a substituent, and n represents an integer of 2 or larger. Z represents a monovalent organic residue, and m represents an integer of 0 to 4.)

In general formula [7], $Ar^{10}$ to $Ar^{15}$ preferably are aryl groups having 6-20 carbon atoms, and these aryl groups may be the same or different. Examples thereof include phenyl, naphthyl, fluorenyl, anthryl, phenanthryl, and pyrenyl. Especially preferred from the standpoint of production cost are aryl groups having 6-10 carbon atoms, such as phenyl and naphthyl. In the case where the aryl groups have substituents, it is preferred that the substituents each should be a substituent which has 1-10 carbon atoms and has a substituent constant $\sigma_p$ in Hammett's rule of 0.20 or smaller. Z represents a monovalent organic residue, and preferably is a substituent having a substituent constant $\sigma_p$ in Hammett's rule of 0.20 or smaller.

Examples of such substituents or monovalent organic residue Z include alkyl groups having 1-4 carbon atoms, alkoxy groups having 1-4 carbon atoms, alkylamino groups having 2-4 carbon atoms, and aryl groups having 6-10 carbon atoms. Specific examples thereof include methyl, ethyl, n-propyl, isopropyl, n-butyl, isobutyl, tert-butyl, methoxy, ethoxy, propoxy, butoxy, N,N-dimethylamino, N,N-diethylamino, phenyl, 4-tolyl, 4-ethylphenyl, 4-propylphenyl, 4-butylphenyl, and naphthyl. Of these, the hydrocarbon groups having 1-4 carbon atoms are especially preferred from the standpoint of electrical properties.

In general formula [7], n preferably is an integer of 2 or larger. From the comprehensive standpoint of compatibility, production cost, etc., the case where n=2 is especially preferred. Symbol m preferably is an integer of 0 or 1. However, from the standpoint of production cost, the case where m=0 is especially preferred.

It is especially preferred that the enamine compound should be a charge-transporting material represented by the following formula [7'].

[Chem. 31]

[7']

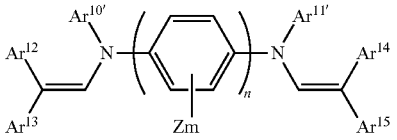

In general formula [7'], $Ar^{10'}$, $Ar^{11'}$, and $Ar^{12}$ to $Ar^{15}$ may be the same or different and each represent an aryl group which may have a substituent; n represents an integer of 2 or larger; Z represents a monovalent organic residue; and m represents an integer of 0 to 4; provided that at least one of $Ar^{10'}$ and $Ar^{11'}$ is an aryl group having a substituent.

In general formula [7'], the preferred ranges of $Ar^{10'}$, $Ar^{11'}$, and $Ar^{12}$ to $Ar^{15}$ are the same as those of $Ar^{10}$ to $Ar^{15}$ in general formula (7), and the preferred ranges of Z and m also are the same as in general formula [7].

Furthermore, in such general formula [7'], the case where m=0 is especially preferred because this brings about satisfactory electrical properties.

Representative examples of the enamine compounds represented by general formulae [6], [7], and [7'] include the following Exemplified Compounds CT-1 to CT-22. However, the enamine compounds according to the invention should not be construed as being limited to the following compounds.

[Chem. 32]

CT-1

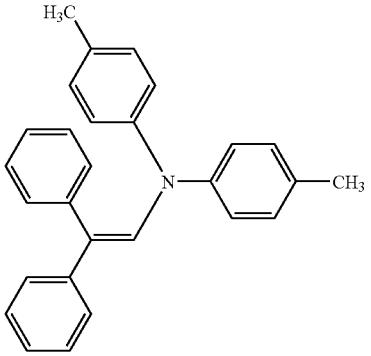

[Chem. 33]

CT-2

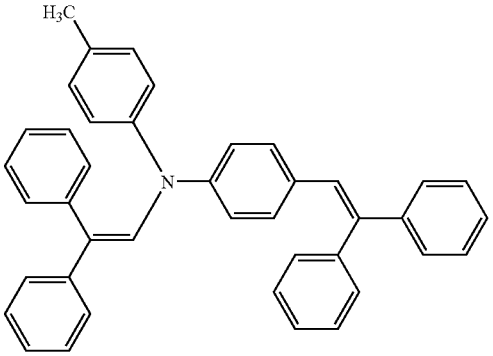

[Chem. 34]

CT-3

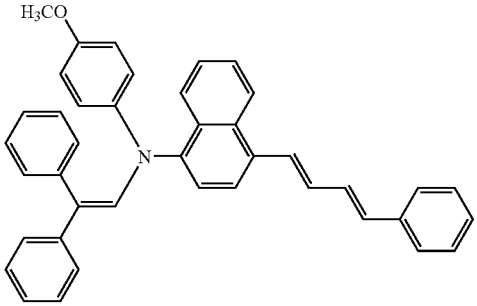

[Chem. 35]

CT-4

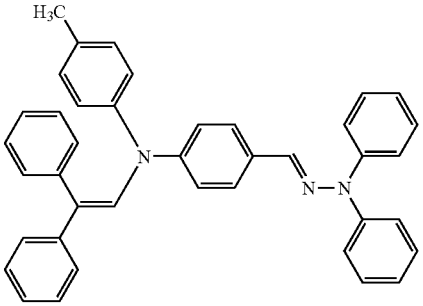

[Chem. 36]

CT-5

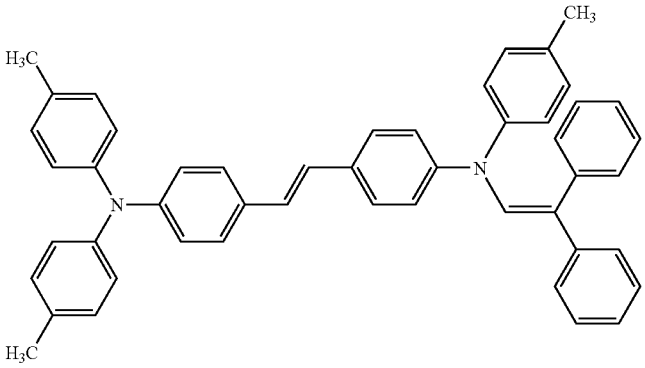

-continued
[Chem. 37]
CT-6
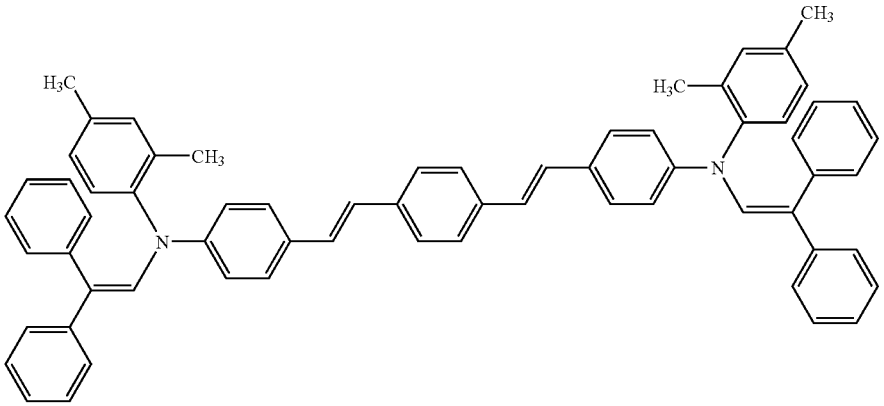
[Chem. 38]
CT-7
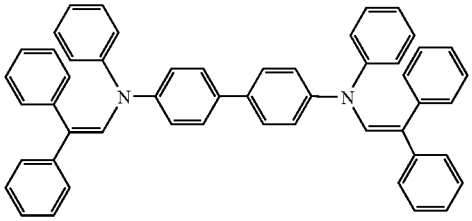
[Chem. 39]
CT-8
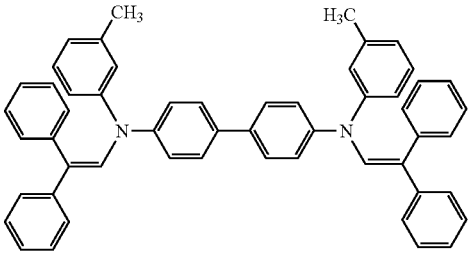
[Chem. 40]
CT-9
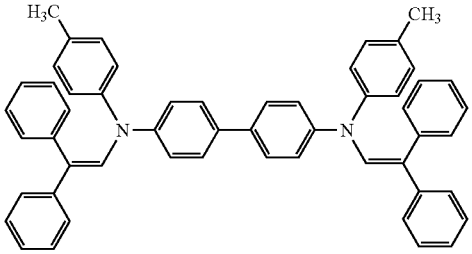
[Chem. 41]
CT-10
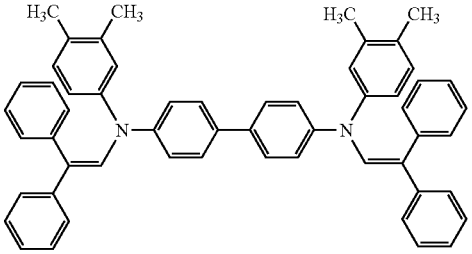
[Chem. 42]
CT-11
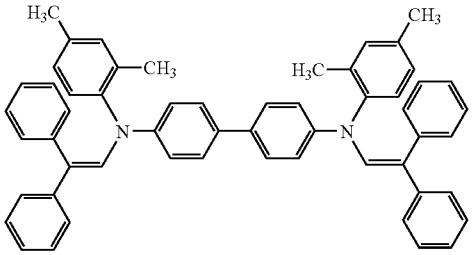
[Chem. 43]
CT-12
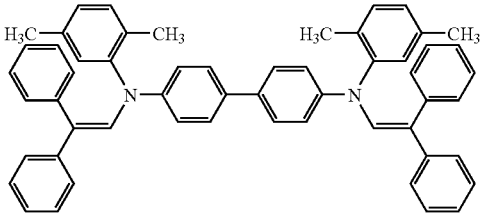
[Chem. 44]
CT-13
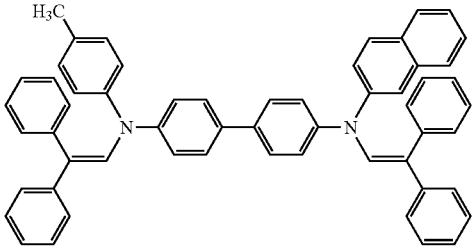
[Chem. 45]
CT-14
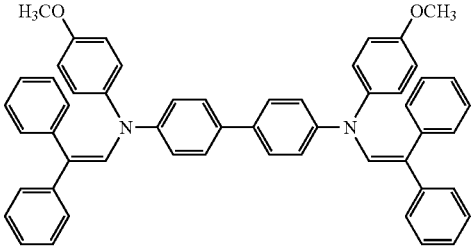

-continued
[Chem. 46]
CT-15
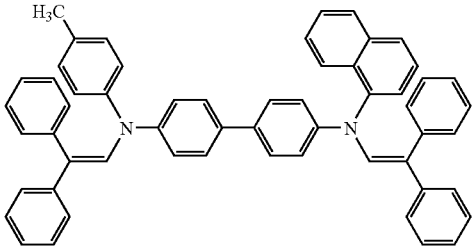
[Chem. 47]
CT-16
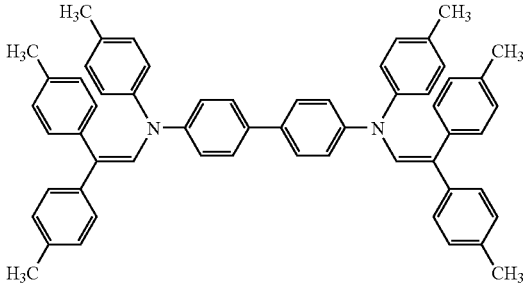
[Chem. 48]
CT-17
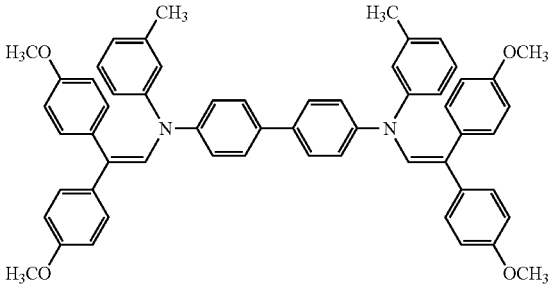
[Chem. 49]
CT-18
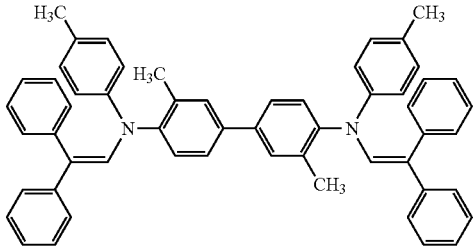
[Chem. 50]
CT-19
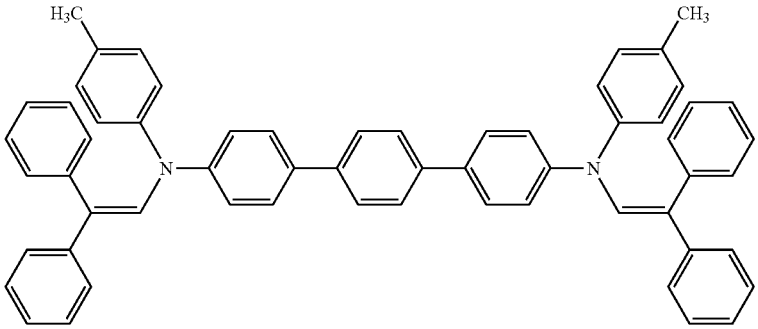
[Chem. 51]
CT-20
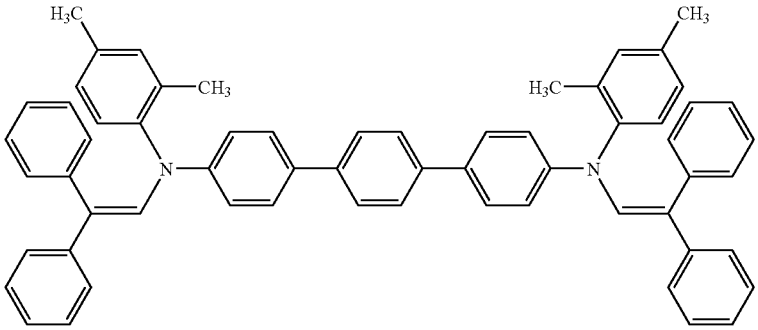

These enamine derivatives can be easily synthesized by known methods. For example, Exemplified Compound CT-9 in the invention can be produced according to the following reaction scheme.

[Chem. 52]

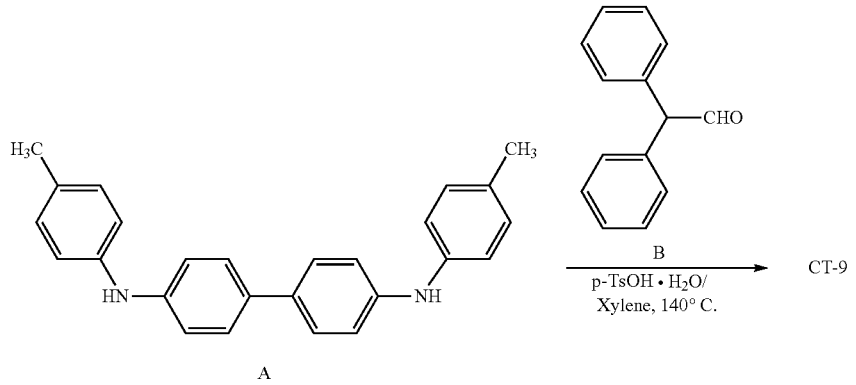

The diarylamine derivative A is condensed with the diarylacetaldehyde B through dehydration with refluxing in the presence of an acid catalyst such as p-toluenesulfonic acid, whereby the target compound, charge-transporting material CT-9, can be obtained.

Although an enamine compound is used as a charge-transporting material in the invention as described above, the enamine compound may be used alone or in combination with another charge-transporting material. The charge-transporting material which may be used in combination with the enamine compound is not particularly limited so long as it is a known material. Examples thereof include electron-attracting materials such as aromatic nitro compounds, e.g., 2,4,7-trinitrofluorenone, cyano compounds, e.g., tetracyanoquinodimethane, and quinone compounds, e.g., diphenoquinone, heterocyclic compounds such as carbazole derivatives, indole derivatives, imidazole derivatives, oxazole derivatives, pyrazole derivatives, thiadiazole derivatives, and benzofuran derivatives, and electron-donating materials such as aniline derivatives, hydrazone derivatives, aromatic amine derivatives, stilbene derivatives, butadiene derivatives, compounds constituted of two or more of these compounds bonded to each other, and polymers having, in the main chain or side chains thereof, a group derived from any of these compounds. Preferred of these are aromatic amine derivatives, stilbene derivatives, hydrazone derivatives, and compounds constituted of two or more of these compounds bonded to each other.

(Preferred Parameter Range for Charge-Transporting Material)

The HOMO energy level E_homo of the charge-transporting substance, which is obtained through the calculation of structural optimization using B3LYP/6-31G(d,p), preferably satisfies E_homo>−4.67 (eV), more preferably satisfies E_homo>−4.65 (eV), and most preferably satisfies E_homo>−4.63 (eV). This is because the higher the HOMO energy level, the lower the post-exposure potential and the better the electrophotographic photoreceptor obtained. On the other hand, too high values of E_homo result in troubles such as a decrease in gas resistance and the occurrence of a ghost. Because of this, the HOMO energy level thereof preferably satisfies E_homo<−4.30 (eV), more preferably satisfies E_homo<−4.50 (eV), and most preferably satisfies E_homo<−4.56 (eV).

Furthermore, the charge-transporting substance, in the stable structure obtained through the calculation of structural optimization using B3LYP/6-31G(d,p), has a calculated value αcal of polarizability α, as determined through the HF/6-31G(d,p) calculation, which preferably satisfies αcal>70 (Å$^3$), more preferably satisfies αcal>80 (Å$^3$), and most preferably satisfies αcal>90 (Å$^3$). The reasons for this are as follows.

A charge-transporting film containing a charge-transporting substance having a large value of αcal shows a high charge mobility, and an electrophotographic photoreceptor excellent in electrification characteristics, sensitivity, etc. can be obtained by using the charge-transporting film. On the other hand, too large values of αcal result in a decrease in the solubility of the charge-transporting substance. Because of this, the calculated value of polarizability generally satisfies αcal<200 (Å$^3$), preferably satisfies αcal<150 (Å$^3$), more preferably satisfies αcal<130 (Å$^3$), and most preferably satisfies αcal<110 (Å$^3$).

In the invention, the HOMO energy level E_homo was obtained by determining a stable structure through the calculation of structural optimization using B3LYP (see A. D. Becke, *J. Chem. Phys.,* 98, 5648 (1993); C. Lee, W. Yang, and R. G. Parr, *Phys. Rev*, B37, 785 (1988), and B. Miehlich, A. Savin, H. Stoll, and H. Preuss, *Chem. Phys. Lett.,* 157, 200 (1989)), which is a kind of density functional calculation. In this case, 6-31G(d,p), obtained by adding a polarization function to 6-31G, was used as a basis function system (see R. Ditchfield, W. J. Hehre, and J. A. Pople, *J. Chem. Phys.,* 54, 724 (1971); W. J. Hehre, R. Ditchfield, and J. A. Pople, *J. Chem. Phys.,* 56, 2257 (1972); P. C. Hariharan and J. A. Pople, *Mol. Phys.,* 27, 209 (1974); M. S. Gordon, *Chem. Phys. Lett.* 76, 163 (1980); P. C. Hariharan and J. A. Pople, *Theo. Chim. Acta,* 28, 213 (1973); J.-P. Blaudeau, M. P. McGrath, L. A. Curtiss, and L. Radom, *J. Chem. Phys.,* 107, 5016 (1997); M. M. Francl, W. J. Pietro, W. J. Hehre, J. S. Binkley, D. J. DeFrees, J. A. Pople, and M. S. Gordon, *J. Chem. Phys.,* 77, 3654 (1982); R. C. Binning Jr. and L. A. Curtiss, *J. Comp. Chem.,* 11, 1206 (1990); V. A. Rassolov, J. A. Pople, M. A. Ratner, and T. L. Windus, *J. Chem. Phys.,* 109, 1223 (1998); and V. A. Rassolov, M. A. Ratner, J. A. Pople, P. C. Redfern, and L. A. Curtiss, *J. Comp. Chem.,* 22, 976 (2001)). In the invention, the B3LYP calculation using 6-31G(d,p) is referred to as B3LYP/6-31G(d,p).

The polarizability αcal was obtained for the stable structure obtained through the calculation of structural optimization using the B3LYP/6-31G(d,p), through a calculation by the restricted Hartree-Fock method (see A. Szabo and N. S. Ostlund, *Modern Quantum Chemistry*, McGraw-Hill publishing company, New York, 1989). In this case, 6-31 G(d,p) was used as a basis function. In the invention, the Hartree-Fock calculation using 6-31 G(d,p) is referred to as HF/6-31G (d,p).

In the invention, the program used for both the B3LYP/6-31G(d,p) calculation and the HF/6-31G(d,p) calculation is Gaussian 03, Revision D.01 (M. J. Frisch, G. W. Trucks, H. B. Schlegel, G. E. Scuseria, M. A. Robb, J. R. Cheeseman, J. A. Montgomery, Jr., T. Vreven, K. N. Kudin, J. C. Burant, J. M. Millam, S. S. Iyengar, J. Tomasi, V. Barone, B. Mennucci, M. Cossi, G. Scalmani, N. Rega, G. A. Petersson, H. Nakatsuji, M. Hada, M. Ehara, K. Toyota, R. Fukuda, J. Hasegawa, M. Ishida, T. Nakajima, Y. Honda, O. Kitao, H. Nakai, M. Klene, X. Li, J. E. Knox, H. P. Hratchian, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, P. Y. Ayala, K. Morokuma, G. A. Voth, P. Salvador, J. J. Dannenberg, V. G. Zakrzewski, S. Dapprich, A. D. Daniels, M. C. Strain, O. Farkas, D. K. Malick, A. D. Rabuck, K. Raghavachari, J. B. Foresman, J. V. Ortiz, Q. Cui, A. G. Baboul, S. Clifford, J. Cioslowski, B. B. Stefanov, G. Liu, A. Liashenko, P. Piskorz, I. Komaromi, R. L. Martin, D. J. Fox, T. Keith, M. A. Al-Laham, C. Y. Peng, A. Nanayakkara, M. Challacombe, P. M. W. Gill, B. Johnson, W. Chen, M. W. Wong, C. Gonzalez, and J. A. Pople, Gaussian, Inc., Wallingford Conn., 2004.).

The charge-transporting material satisfying the parameter according to the invention is not limited in the structure thereof. Examples thereof include electron-donating materials such as enamine derivatives, carbazole derivatives, aniline derivatives, hydrazone derivatives, aromatic amine derivatives, stilbene derivatives, butadiene derivatives, compounds constituted of two or more of these compounds bonded to each other, and polymers having, in the main chain or side chains thereof, a group derived from any of these compounds. Preferred of these are enamine derivatives, stilbene derivatives, hydrazone derivatives, and compounds constituted of two or more of these compounds bonded to each other. In particular, enamine derivatives are preferred. On the other hand, in case where a polyarylate resin is used as a binder and a butadiene derivative is used as a charge-transporting material, the coating fluid is apt to deteriorate as shown in JP-A-2007-213052. It is therefore preferred that the charge-transporting material in the invention should be one which has no butadiene framework.

The charge-transporting material having the parameter according to the invention may be used in combination with a charge-transporting material having a parameter outside the range according to the invention. However, from the standpoint of sufficiently producing the effects of the invention described above, the proportion of the charge-transporting material having the parameter according to the invention in all charge-transporting materials is generally 30% by mass or higher, preferably 50% by mass or higher, more preferably 80% by mass or higher, most preferably 100% by mass.

The amount of the charge-transporting material having the parameter according to the invention is generally 30 parts by mass or larger, preferably 40 parts by mass or larger, more preferably 50 parts by mass or larger, per 100 parts by mass of the binder resin from the standpoint of sufficiently producing the effects of the invention described above. The charge-transporting material having the parameter according to the invention has an advantage of producing the effect thereof even when used in a relatively small amount. When wearing resistance also is taken into account, the amount of the charge-transporting material is preferably about 90 parts by mass or smaller, more preferably 70 parts by mass or smaller, most preferably 55 parts by mass or smaller.

The charge-transporting material having the parameter according to the invention is especially effective when a polyarylate resin having a repeating structure represented by formula [1] is used. Use of polyarylate resins result in poorer electrical properties as compared with polycarbonate resins. However, when the charge-transporting material having the parameter according to the invention is used, excellent wearing resistance can be reconciled with excellent electrical properties. The preferred structure of the polyarylate resin having a repeating structure represented by formula [1] is the same as in the polyarylate resin described above.

Examples of the charge-transporting material having the parameter according to the invention are shown below.

[Chem. 53]

| Charge-transporting material | E_homo (eV) | αcal (Å$^3$) |
|---|---|---|
| 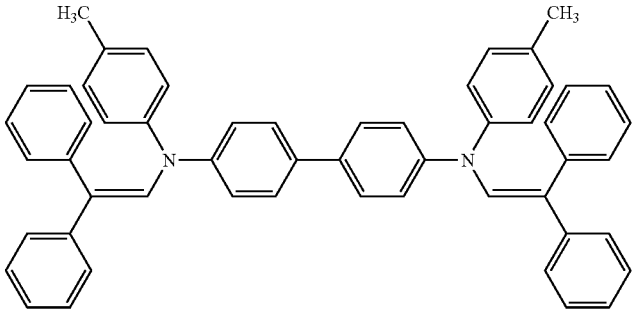 | −4.60 | 89.2 |

-continued

[Chem. 53]

| Charge-transporting material | E_homo (eV) | αcal (Å³) |
|---|---|---|
| 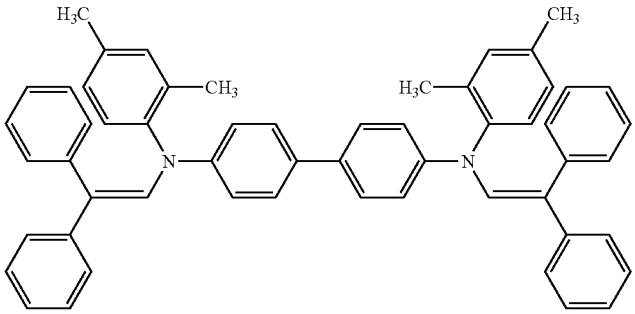 | −4.62 | 91.7 |
| 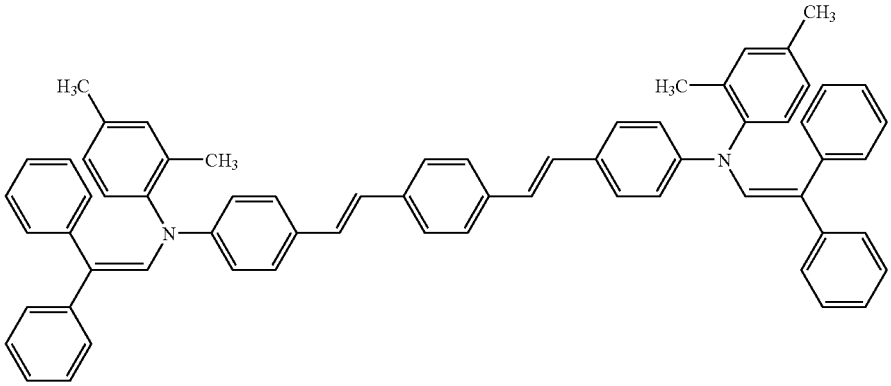 | −4.56 | 122.4 |

(Conductive Substrate)

As the conductive substrate, use is mainly made of, for example, a metallic material such as aluminum, an aluminum alloy, stainless steel, copper, and nickel, a resinous material to which conductivity has been imparted by adding a conductive powder of, e.g., a metal, carbon, or tin oxide, or a resin, glass, or paper having a conductive material, e.g., aluminum, nickel, or ITO (indium-tin oxide), vapor-deposited or applied on a surface thereof. With respect to shape, the conductive substrate to be used may be in a drum, sheet, or belt form or the like. A substrate obtained by coating a conductive substrate made of a metallic material with a conductive material having a suitable value of resistance in order to regulate conductivity, surface properties, or the like and to hide defects may also be used.

In the case where a metallic material such as an aluminum alloy is to be used as the conductive substrate, this material may be used after having been subjected to anodization, a treatment for forming chemical conversion coating, etc. In the case where anodization is conducted, it is desirable to subject the anodized substrate to a pore-filling treatment by a known method.

The surface of the conductive substrate may be smooth or may have been roughened by a special grinding technique or polishing technique. Furthermore, a conductive substrate having a roughened surface imparted thereto by incorporating particles of a suitable particle diameter into the material constituting the substrate may also be used.

(Undercoat Layer)

An undercoat layer may be disposed between the conductive substrate and the photosensitive layer in order to improve adhesiveness, nonblocking properties, etc.

As the undercoat layer, use may be made of a resin, a material obtained by dispersing particles of, e.g., a metal oxide in a resin, or the like. Examples of the metal oxide particles for use in the undercoat layer include particles of a metal oxide containing one metallic element, such as titanium oxide, aluminum oxide, silicon oxide, zirconium oxide, zinc oxide, or iron oxide, and particles of a metal oxide containing two or more metallic elements, such as calcium titanate, strontium titanate, or barium titanate. Metal oxide particles of one kind only may be used as shown above, or a mixture of two or more kinds of metal oxide particles may be used. Preferred of these particulate metal oxides are titanium oxide and aluminum oxide. Especially preferred is titanium oxide. The titanium oxide particles may be ones in which the surface thereof has undergone a treatment with an inorganic substance, e.g., tin oxide, aluminum oxide, antimony oxide, zirconium oxide, or silicon oxide, or with an organic substance, e.g., stearic acid, a polyol, or a silicone. The crystal form of the titanium oxide particles may be any of rutile, anatase, brucite, and amorphous. Two or more crystalline states may be included.

With respect to particle diameter, metal oxide particles having various particle diameters can be used. However, metal oxide particles having a particle diameter of from 10 nm to 100 nm in terms of average primary-particle diameter are preferred from the standpoints of properties and liquid stability. Especially preferred are metal oxide particles having a particle diameter of from 10 nm to 50 nm.

It is desirable that an undercoat layer should be formed so as to be constituted of a binder resin and metal oxide particles dispersed in the resin. As the binder resin for the undercoat layer, use may be made of a phenoxy, epoxy, polyvinylpyrrolidone, poly(vinyl alcohol), casein, poly(acrylic acid), cellulose derivative, gelatin, starch, polyurethane, polyimide, polyamide, or the like. Such a polymer can be used alone or in a cured form obtained with a hardener. Of these, an alcohol-soluble copolyamide or modified polyamide or the like is preferred because such polyamides show satisfactory dispersibility and applicability.

The proportion of the inorganic particles to the binder resin can be selected at will. However, from the standpoint of the stability and applicability of the dispersion, it is preferred to use the inorganic particles in an amount in the range of from 10% by mass to 500% by mass.

The thickness of the undercoat layer can be selected at will. However, the thickness thereof is preferably from 0.1 μm to 25 μm from the standpoints of photoreceptor characteristics and applicability. A known antioxidant and the like may be added to the undercoat layer.

(Photosensitive Layer)

The photosensitive layer to be formed on the conductive substrate (or on the undercoat layer described above, when the undercoat layer is formed) is explained next. The photosensitive layer is a layer containing both the polyarylate resin described above, which has a repeating structure represented by general formula [1] or [9], and the enamine compound described above. Examples of the type thereof include: the single-layer type constituted of a single layer in which a charge-generating material and a charge-transporting material (including the enamine compound) have been dispersed or dissolved in the polyarylate resin as a binder resin; and the multilayer type composed of two layers, i.e., a charge-generating layer including a binder resin and a charge-generating material dispersed or dissolved in the resin and a charge-transporting layer including the polyarylate resin as a binder resin and a charge-transporting material (including the enamine compound) dispersed or dissolved in the resin. Either of these types may be employed. It is generally known that a charge-transporting material in the single-layer type performs the same charge-transporting function as the charge-transporting material in the multilayer type.

Examples of the multilayer type photosensitive layer include: a normal superposition type photosensitive layer composed of a charge-generating layer and a charge-transporting layer which have been laminated in this order from the conductive-substrate side; and a reverse superposition type photosensitive layer composed of a charge-transporting layer and a charge-generating layer which have been laminated in this order. Although either of these can be employed, the normal superposition type photosensitive layer is preferred because this photosensitive layer can exhibit most highly balanced photoconductivity. The following explanation is given on the multilayer type photoreceptor unless otherwise indicated.

(Charge-Generating Layer)

In the case where the photosensitive layer is of the multilayer type, examples of charge-generating materials usable in the charge-generating layer thereof include various photoconductive materials such as selenium and alloys thereof, cadmium sulfide, and other inorganic photoconductive materials, and organic pigments including phthalocyanine pigments, azo pigments, quinacridone pigments, indigo pigments, perylene pigments, polycyclic quinone pigments, anthanthrone pigments, and benzimidazole pigments. Of these, organic pigments are preferred. In particular, phthalocyanine pigments and azo pigments are preferred. These charge-generating materials are used in the state of being bound with various binder resins such as, e.g., polyarylate resins, poly(vinyl acetate), poly(acrylic ester)s, poly(methacrylic ester)s, polyarylates, polycarbonates, poly(vinyl acetoacetal), poly(vinyl propional), poly(vinyl butyral), phenoxy resins, epoxy resins, urethane resins, cellulose esters, and cellulose ethers. In this case, a charge-generating material may be used in such a proportion that the amount of the charge-generating material is in the range of from 30 parts by mass to 500 parts by mass per 100 parts by mass of the binder resin. A suitable film thickness thereof is generally from 0.1 μm to 1 μm, preferably from 0.15 μm to 0.6 μm.

In the case where a phthalocyanine compound is used as a charge-generating material, usable examples thereof include metal-free phthalocyanines and phthalocyanine compounds to which a metal, e.g., copper, indium, gallium, tin, titanium, zinc, vanadium, silicon, or germanium, or an oxide, halide, or another form of the metal has coordinated. Examples of ligands for metal atoms having a valence of 3 or higher include an oxygen atom, chlorine atom, hydroxy, and alkoxy. Especially suitable are X-form and τ-form metal-free phthalocyanines, which have high sensitivity, A-form, B-form, D-form, and other titanyl phthalocyanines, vanadyl phthalocyanines, chloroindium phthalocyanines, chlorogallium phthalocyanines, and hydroxygallium phthalocyanines. Of the crystal forms of titanyl phthalocyanines shown above, the A-form and B-form were referred to as I-phase and II-phase, respectively, by W. Heller et al. (*Zeit. Kristallogr.,* 159 (1982) 173), and the A-form is known as a stable form. The D-form is a crystal form characterized by showing a distinct peak at a diffraction angle 2θ±0.2° of 27.3° in X-ray powder diffractometry using a CuKα line. A single phthalocyanine compound may be used alone, or some phthalocyanine compounds may be used in the state of being mixed with each other. In the case where phthalocyanine compounds are to be used in a mixed state, the constituent elements may be mixed later together and used. Alternatively, the phthalocyanine compounds may be ones the mixed state of which was generated in a phthalocyanine compound production/treatment step such as, e.g., synthesis, pigment formation, or crystallization. Known as such treatments are an acid paste treatment, grinding, solvent treatment, and the like.

(Charge-Transporting Layer)

In the case where the photosensitive layer is of the multilayer type, the enamine compound is used as a charge-transporting material in the charge-transporting layer thereof. As stated above, the enamine compound may be used alone or may be used in combination with another charge-transporting material. Such charge-transporting material is bound with a binder resin including a polyarylate resin having a repeating structure represented by general formula [1] or [9] to form a charge-transporting layer. The charge-transporting layer may be constituted of a single layer, or may be composed of superposed layers differing in component or composition.

The binder resin and the charge-transporting material are used in such a ratio that the amount of the charge-transporting material is in the range of generally from 30 parts by mass to 200 parts by mass, preferably from 40 parts by mass to 150 parts by mass, per 100 parts by mass of the binder resin. In the case where the enamine compound is used in combination with another charge-transporting material, the proportions of the enamine compound and the other charge-transporting material are not limited. However, the proportion of the enamine compound is generally 50% by mass or higher, preferably 90% by mass or higher. It is especially preferred that the enamine compound should be used as the only charge-transporting material. The film thickness thereof is generally from 5 μm to 50 μm, preferably from 10 μm to 45 μm.

Known additives such as, e.g., a plasticizer, antioxidant, ultraviolet absorber, electron-attracting compound, dye, pigment, and leveling agent may be incorporated into the charge-transporting layer in order to improve film-forming properties, flexibility, applicability, nonfouling properties, gas resistance, light resistance, etc. Examples of the antioxidant include hindered phenol compounds and hindered amine compounds. Examples of the dye and pigment include various colorant compounds and azo compounds.

The dispersion type (single-layer type) photosensitive layer is then explained. In the case where the photosensitive layer is of the dispersion type, the charge-generating material described above is dispersed in a charge-transporting medium having a composition such as that shown above. In this case, it is necessary that the charge-generating material should have a sufficiently small particle diameter. The charge-generating material to be used has a particle diameter of preferably 1 μm or smaller, more preferably 0.5 μm or smaller. In case where the amount of the charge-generating material to be dispersed in the photosensitive layer is too small, sufficient sensitivity is not obtained. Too large amounts thereof exert an adverse influence to result in a decrease in electrification characteristics, decrease in sensitivity, etc. For example, the charge-generating material is used in an amount preferably in the range of from 0.5% by mass to 50% by mass, more preferably in the range of from 1% by mass to 20% by mass.

The thickness of the dispersion type photosensitive layer is generally from 5 μm to 50 μm, more preferably from 10 μm to 45 μm. In this case also, a known plasticizer for improving film-forming properties, flexibility, mechanical strength, etc., an additive for reducing residual potential, a dispersion aid for improving dispersion stability, a leveling agent or surfactant for improving applicability, and other additives such as, e.g., a silicone oil or fluorochemical oil may have been added.

A protective layer may be formed on the dispersion type photosensitive layer or multilayer type photosensitive layer for the purposes of preventing the photosensitive layer from wearing and of preventing/diminishing the deterioration of the photosensitive layer caused by, e.g., a product of discharge generated from charging devices, etc. A surface layer may contain a fluororesin, silicone resin, or the like for the purpose of reducing the frictional resistance or wear of the photoreceptor surface. The surface layer may contain particles of any of these resins or particles of an inorganic compound.

(Method of Forming the Layers)

The layers constituting an electrophotographic photoreceptor may be formed by successively applying, to a conductive substrate, coating fluids obtained by dissolving or dispersing in a solvent the materials to be incorporated. The coating fluids are applied by a known technique such as, e.g., dip coating, spray coating, nozzle coating, bar coating, roll coating, or blade coating. Of these, dip coating is preferred from the standpoint of high productivity.

The solvent, i.e., solvent or dispersion medium, to be used for producing the coating fluids is not particularly limited. Examples thereof include alcohols such as methanol, ethanol, propanol, and 2-methoxyethanol, ethers such as tetrahydrofuran, 1,4-dioxane, and dimethoxyethane, esters such as methyl formate and ethyl acetate, ketones such as acetone, methyl ethyl ketone, cyclohexanone, and 4-methoxy-4-methyl-2-pentanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene, nitrogen-containing compounds such as n-butylamine, isopropanolamine, diethylamine, triethanolamine, ethylenediamine, and triethylenediamine, and aprotic polar solvents such as acetonitrile, N-methylpyrrolidone, N,N-dimethylformamide, and dimethyl sulfoxide. One of these may be used alone, or any desired combination of any desired two or more kinds thereof may be used.

The amount of the solvent to be used is not particularly limited. It is, however, preferred to suitably regulate the solvent amount so that properties of each coating fluid, such as solid concentration and viscosity, come to be in desired ranges while taking account of the purpose of each layer and the properties of the solvent selected.

The polyarylate resin, which is used as a binder resin in the invention, is preferred because this resin shows excellent solubility in the solvents used in the coating step and because the coating solutions obtained through the dissolution thereof have excellent stability.

[Image-Forming Apparatus]

A embodiment of the image-forming apparatus employing an electrophotographic photoreceptor of the invention (image-forming apparatus of the invention) is explained below by reference to FIG. 1, which illustrates the constitution of important parts of the apparatus. However, embodiments of the apparatus should not be construed as being limited to that explained below, and the apparatus can be modified at will so long as the modifications do not depart from the spirit of the invention.

As shown in FIG. 1, the image-forming apparatus includes an electrophotographic photoreceptor 1, a charging device (charging part) 2, an exposure device (exposure part) 3, and a developing device (developing part) 4. The apparatus may further has a transfer device 5, a cleaner 6, and a fixing device 7 according to need.

The electrophotographic photoreceptor 1 is not particularly limited so long as it is any of the electrophotographic photoreceptors of the invention described above. FIG. 1 shows, as an example thereof, a drum-shaped electrophotographic photoreceptor constituted of a cylindrical conductive substrate and, formed on the surface thereof, the photosensitive layer described above. The charging device 2, exposure device 3, developing device 4, transfer device 5, and cleaner 6 have been disposed along the peripheral surface of this electrophotographic photoreceptor 1.

The charging device 2 serves to charge the electrophotographic photoreceptor 1. It evenly charges the surface of the electrophotographic photoreceptor 1 to a given potential. FIG. 1 shows a roller type charging device (charging roller) as an example of the charging device 2. However, corona charging devices such as corotrons and scorotrons, contact type charging devices such as charging brushes and charging films, and the like are frequently used besides the charging rollers.

In many cases, the electrophotographic photoreceptor 1 and the charging device 2 have been designed to constitute a cartridge (electrophotographic photoreceptor cartridge of the invention; hereinafter suitably referred to as "photoreceptor cartridge") which involves these two members and is removable from the main body of the image-forming apparatus. It is, however, noted that the charging device 2 may have been disposed in the main body of the image-forming apparatus separately from the cartridge. When, for example, the electrophotographic photoreceptor 1 and the charging device 2 have deteriorated, this photoreceptor cartridge can be removed from the main body of the image-forming apparatus and a fresh photoreceptor cartridge can be mounted in the main body of the image-forming apparatus. Also with respect to the toner, which will be described later, the toner in many cases has been designed to be stored in a toner cartridge and be removable from the main body of the image-forming apparatus. In this constitution, when the toner in the toner cartridge in use has run out, this toner cartridge can be removed from the main body of the image-forming apparatus and a fresh toner cartridge can be mounted. Furthermore, there are cases where a cartridge including all of the electrophotographic photoreceptor 1, a charging device 2, and a toner is used.

The exposure device 3 is not particularly limited in kind so long as it can illuminate the electrophotographic photoreceptor 1 and thereby form an electrostatic latent image in the photosensitive surface of the electrophotographic photoreceptor 1. Examples thereof include halogen lamps, fluorescent lamps, lasers such as semiconductor lasers and He-Ne lasers, and LEDs. It is also possible to conduct exposure by the technique of internal photoreceptor exposure. Although any desired light can be used for exposure, a monochromatic light is generally preferred. For example, the monochromatic light having a wavelength of 780 nm, a monochromatic light having a slightly short wavelength of 600-700 nm, a monochromatic light having a short wavelength of 380-500 nm, or the like may be used to conduct exposure.

The developing device 4 is not particularly limited in kind so long as the electrostatic latent image formed in the surface of the exposed electrophotographic photoreceptor 1 can be developed by the device 4 to form a visible image. Examples thereof include ones operated by a dry development technique, e.g., cascade development, development with one-component conductive toner, or two-component magnetic brush development, a wet development technique, etc. In FIG. 1, the developing device 4 includes a developing chamber 41, agitators 42, a feed roller 43, a developing roller 44, and a control member 45. This device has such a constitution that a toner T is stored in the developing chamber 41. According to need, the developing device 4 may be equipped with a replenishing device (not shown) for replenishing the toner T. This replenishing device has such a constitution that the toner T can be supplied from a container such as a bottle or cartridge.

The feed roller 43 is made of an electrically conductive sponge, etc. The developing roller 44 is constituted of, for example, a metallic roll made of iron, stainless steel, aluminum, nickel, or the like or a resinous roll obtained by coating such a metallic roll with a silicone resin, urethane resin, fluororesin, or the like. The surface of this developing roller 44 may be subjected to a surface-smoothing processing or surface-roughening processing according to need.

The developing roller 44 is disposed between the electrophotographic photoreceptor 1 and the feed roller 43 and is in contact with each of the electrophotographic photoreceptor 1 and the feed roller 43. It is, however, noted that the developing roller 44 and the electrophotographic photoreceptor 1 may be located near to each other without being in contact with each other. The feed roller 43 and the developing roller 44 are rotated by a rotation driving mechanism (not shown). The feed roller 43 holds the toner T stored and supplies it to the developing roller 44. The developing roller 44 holds the toner T supplied by the feed roller 43 and brings it into contact with the surface of the electrophotographic photoreceptor 1.

The control member 45 is constituted of a resinous blade made of a silicone resin, urethane resin, or the like, a metallic blade made of stainless steel, aluminum, copper, brass, phosphor bronze, or the like, a blade obtained by coating such a metallic blade with a resin, etc. This control member 45 usually is in contact with the developing roller 44 and is pushed against the developing roller 44 with a spring or the like at a given force (the linear blade pressure is generally 0.049-4.9 N/cm). According to need, this control member 45 may have the function of charging the toner T based on electrification by friction with the toner T.

The agitators 42 are disposed according to need, and each are rotated by the rotation driving mechanism. They agitate the toner T and convey the toner T to the feed roller 43 side. Two or more agitators 42 differing in blade shape, size, etc. may be disposed.

The kind of the toner T is not limited. A polymerization toner obtained by the suspension polymerization method, emulsion polymerization method, or the like or a similar toner can be used besides a pulverization toner. Especially when a polymerization toner is used, this toner preferably has a small particle diameter of about from 4 μm to 8 μm. With respect to the shape of toner particles, toner particles of various shapes ranging from a nearly spherical shape to an aspherical potato shape can be used. Polymerization toners are excellent in electrification evenness and transferability and are suitable for use in attaining higher image quality.

The transfer device 5 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 5 is one constituted of a transfer charger, transfer roller, transfer belt, or the like disposed so as to face the electrophotographic photoreceptor 1. A given voltage (transfer voltage) which has the polarity opposite to that of the charge potential of the toner T is applied to the transfer device 5, and this transfer device 5 thus transfers the toner image formed on the electrophotographic photoreceptor 1 to a recording paper (paper or medium) P.

The cleaner 6 is not particularly limited, and any desired cleaner can be used, such as a brush cleaner, magnetic brush cleaner, electrostatic brush cleaner, magnetic roller cleaner, or blade cleaner. The cleaner 6 serves to scrape off the residual toner adherent to the electrophotographic photoreceptor 1 with a cleaning member and thus recover the residual toner. Incidentally, when there is little or almost no residual toner, the cleaner 6 may be omitted.

The fixing device 7 is constituted of an upper fixing member (pressure roller) 71 and a lower fixing member (fixing roller) 72. The fixing member 71 or 72 is equipped with a heater 73 inside. FIG. 1 shows an example in which the upper fixing member 71 is equipped with a heater 73 inside. As the upper and lower fixing members 71 and 72 can be used a known heat-fixing member such as a fixing roll obtained by coating a metallic tube made of stainless steel, aluminum, or the like with a silicone rubber, a fixing roll obtained by further coating that fixing roll with a Teflon (registered trademark) resin, or a fixing sheet. Furthermore, the fixing members 71 and 72 each may have a constitution in which a release agent such as a silicone oil is supplied thereto in order to improve release properties, or may have a constitution in which the two members are forcedly pressed against each other with a spring or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P.

The fixing device also is not particularly limited in kind. Fixing devices which can be mounted include ones operated by any desired fixing technique, such as heated-roller fixing, flash fixing, oven fixing, or pressure fixing, besides the device used here.

In the image-forming apparatus having the constitution described above, image recording is conducted in the following manner. First, the surface (photosensitive surface) of the electrophotographic photoreceptor 1 is charged to a given potential (e.g., −600 V) by the charging device 2. This charging may be conducted with a direct-current voltage or with a direct-current voltage on which an alternating-current voltage has been superimposed.

Subsequently, the charged photosensitive surface of the electrophotographic photoreceptor 1 is exposed by the exposure device 3 according to the image to be recorded. Thus, an electrostatic latent image is formed in the photosensitive surface. This electrostatic latent image formed in the photosensitive surface of the electrophotographic photoreceptor 1 is developed by the developing device 4.

In the developing device 4, the toner T fed by the feed roller 43 is formed into a thin layer with the control member (developing blade) 45 and, simultaneously therewith, frictionally charged so as to have a given polarity (here, the toner is charged so as to have negative polarity, which is the same as the polarity of the charge potential of the electrophotographic photoreceptor 1). This toner T is conveyed while being held by the developing roller 44 and is brought into contact with the surface of the electrophotographic photoreceptor 1.

When the charged toner T held on the developing roller 44 comes into contact with the surface of the electrophotographic photoreceptor 1, a toner image corresponding to the electrostatic latent image is formed on the photosensitive surface of the electrophotographic photoreceptor 1. This toner image is transferred to a recording paper P by the transfer device 5. Thereafter, the toner which has not been transferred and remains on the photosensitive surface of the electrophotographic photoreceptor 1 is removed by the cleaner 6.

After the transfer of the toner image to the recording paper P, this recording paper P is passed through the fixing device 7 to thermally fix the toner image to the recording paper P. Thus, a finished image is obtained.

Incidentally, the image-forming apparatus may have a constitution in which an erase step, for example, can be conducted, in addition to the constitution described above. The erase step is a step in which the electrophotographic photoreceptor is exposed to a light to thereby erase the residual charges from the electrophotographic photoreceptor. As an eraser may be used a fluorescent lamp, LED, or the like. The light to be used in the erase step, in many cases, is a light having such an intensity that the exposure energy thereof is at least 3 times the energy of the exposure light.

The constitution of the image-forming apparatus may be further modified. For example, the apparatus may have a constitution in which steps such as a pre-exposure step and an auxiliary charging step can be conducted, or have a constitution in which offset printing is conducted. Furthermore, the apparatus may have a full-color tandem constitution employing two or more toners.

In this embodiment, the electrophotographic photoreceptor cartridge of the invention was explained using, as an example, a photoreceptor cartridge including the electrophotographic photoreceptor 1 and a charging device 2. However, the electrophotographic photoreceptor cartridge of the invention is not limited so long as the cartridge includes the electrophotographic photoreceptor 1 and at least one of a charging device (charging part) 2, exposure device (exposure part) 3, developing device (developing part) 4, transfer device (transfer part) 5, cleaner (cleaning part) 6, and fixing device (fixing part) 7. Specifically, the electrophotographic photoreceptor cartridge of the invention may be constituted, for example, so as to include all of the following: the electrophotographic photoreceptor 1, a charging device (charging part) 2, an exposure device (exposure part) 3, a developing device (developing part) 4, and a cleaner (cleaning part) 6.

EXAMPLES

The embodiment will be explained below in more detail by reference to Examples. The following Examples are given in order to explain the invention in detail, and the invention should not be construed as being limited to the following Examples unless the invention departs from the spirit thereof. Each "parts" in the following Examples, Comparative Examples, and Reference Examples means "parts by mass" unless otherwise indicated.

Production of Enamine Compound

With respect to the production of enamine compounds, the production of CT-9 is explained as a representative example.

Production Example 1

Production of Exemplified Compound CT-9

Figure 3:
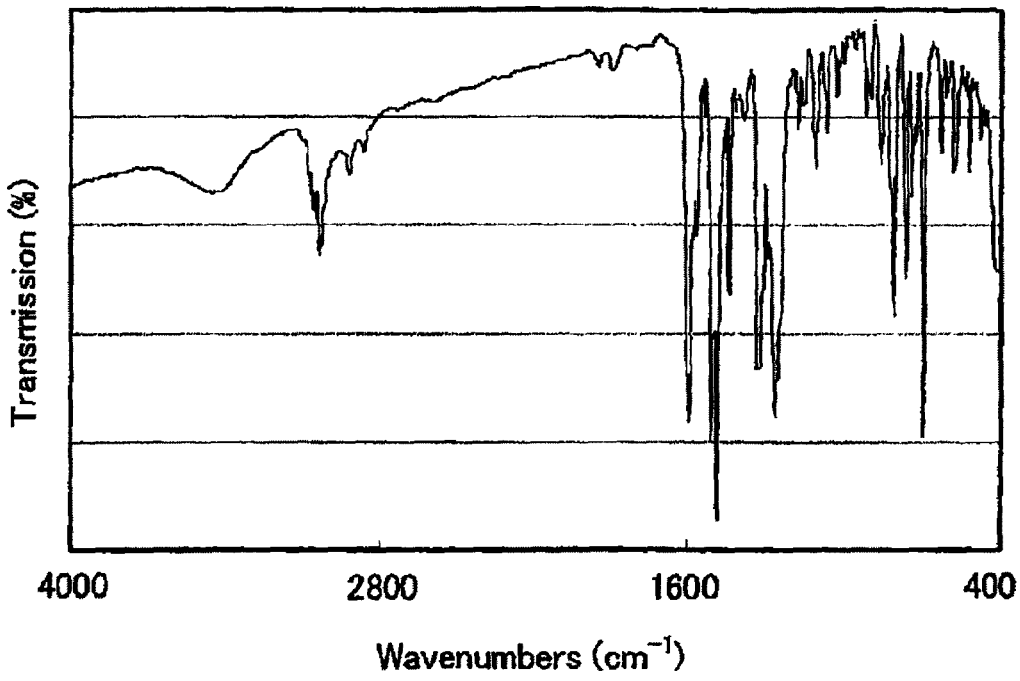
FIG. 3 is an IR spectrum of Exemplified Compound CT-9 according to the invention.

In a nitrogen atmosphere, a reflux tube and a Dean-Stark water separator were successively set on a reaction vessel. Into the reaction vessel were introduced 7.29 g (20 mmol) of N,N'-di(p-tolyl)benzidine, 8.63 g (44 mmol) of diphenylacetaldehyde, and 0.20 g of p-toluenesulfonic acid monohydrate. These ingredients were dissolved in 50 mL of xylene with stirring. Thereafter, the contents were refluxed and dehydrated for 2 hours while maintaining a temperature of 140° C., and then cooled to room temperature. The resultant liquid reaction mixture was mixed with toluene/desalted water (v/v=1:1), and this mixture was stirred and allowed to separate into liquids. The organic layer obtained was washed with 1-N aqueous NaOH solution and separated from the aqueous phase. This organic layer was further subjected, two to three times, to washing with desalted water and separation therefrom. The solvent was removed by vacuum distillation from the organic layer obtained. The residual reaction product was passed through a flash column chromatograph (silica gel, 400 g; developing solvent, toluene/hexane=1/2) and further purified by recrystallization from methanol. This reaction product was vacuum-dried to obtain Exemplified Compound CT-9 as a yellow powder (amount yielded, 10.81 g; yield, 75%; purity, 99.5%). This value of purity was calculated from simple areal proportions in a chart obtained by high-performance liquid chromatography. An IR spectrum of this compound (JASCO FT/IR-350 spectrophotometer) is shown in FIG. 3.

Example 1

Electrophotographic Photoreceptor A1

A conductive substrate obtained by forming a vapor-deposited aluminum layer (thickness, 70 nm) on a surface of a biaxially stretched poly(ethylene terephthalate) resin film (thickness, 75 μm) was used. The dispersion for undercoat layer formation shown below was applied on the vapor-deposited aluminum layer of the conductive substrate with a bar coater in a thickness of 1.25 μm on a dry basis. The dispersion applied was dried to form an undercoat layer.

A dispersion for undercoat layer formation was prepared in the following manner. Into a high-speed flow type mixing/kneading machine ("SMG300", manufactured by Kawata MFG. Co., Ltd.) were introduced rutile titanium oxide having an average primary-particle diameter of 40 nm ("TTO55N", manufactured by Ishihara Sangyo Kaisha, Ltd.) and methyldimethoxysilane ("TSL8117", manufactured by Toshiba Silicone Co., Ltd.), the amount of the silane being 3% by mass based on the titanium oxide. The ingredients were mixed together at a high rotation speed of 34.5 m/sec in terms of peripheral speed. The surface-treated titanium oxide obtained was dispersed in methanol/1-propanol with a ball mill to thereby obtain a dispersion slurry of the hydrophobized titanium oxide. This dispersion slurry was mixed with a methanol/1-propanol/toluene mixed solvent and with pellets of a copolyamide composed of c-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a molar ratio of 60%/15%/5%/15%/5%, with stirring and heating to dissolve the polyamide pellets. Thereafter, the resultant mixture was subjected to an ultrasonic dispersion treatment. Thus, a dispersion for undercoat layer formation having a solid concentration of 18.0% was obtained in which the methanol/1-propanol/toluene ratio was 7/1/2 by mass and which contained the hydrophobized titanium oxide and the copolyamide in a titanium oxide/copolyamide ratio of 3/1 by mass.

[Chem. 54]

A

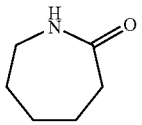

B

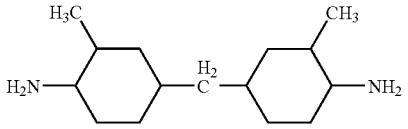

C

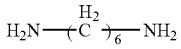

D

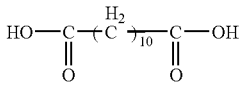

E

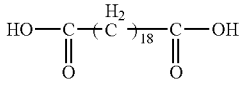

The coating fluid for undercoat layer formation thus obtained was applied to the poly(ethylene terephthalate) sheet coated with vapor-deposited aluminum, with a wire-wound bar in a thickness of 1.25 μm on a dry basis. The coating fluid applied was dried to form an undercoat layer.

Figure 2:
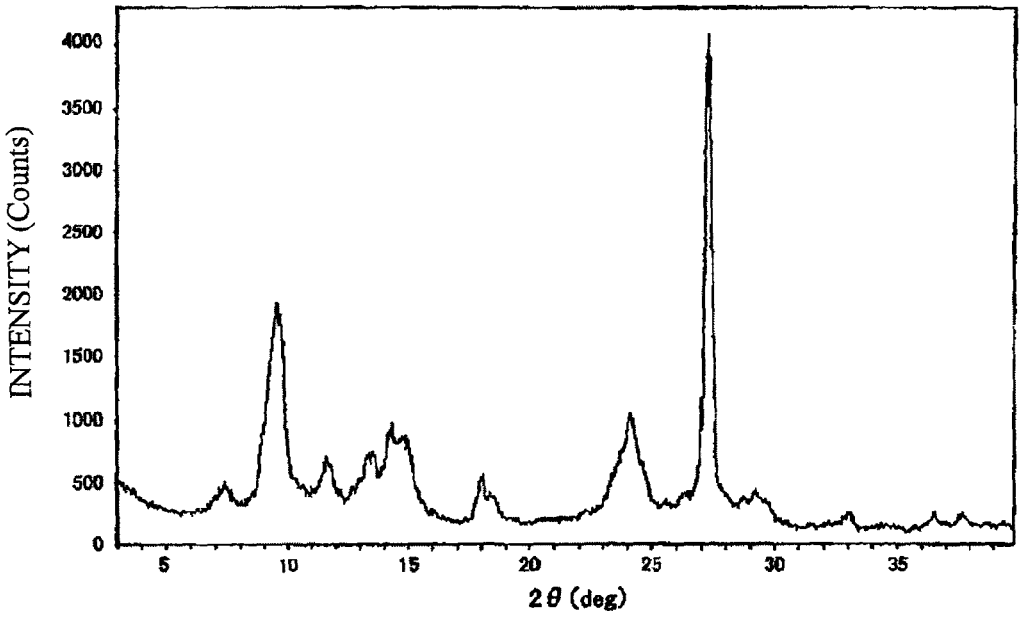
FIG. 2 is an X-ray diffraction pattern of the oxytitanium phthalocyanine used in Examples.

Subsequently, 10 parts by mass of oxytitanium phthalocyanine showing an intense diffraction peak at a Bragg angle (2θ±0.2) of 27.3° in X-ray diffractometry with a CuKα line and having the X-ray powder diffraction spectrum shown in FIG. 2 was added to 150 parts by mass of 1,2-dimethoxyethane. This mixture was subjected to a pulverization/dispersion treatment with a sand grinding mill to produce a pigment dispersion. A hundred and sixty parts by mass of the pigment dispersion thus obtained was mixed with 100 parts by mass of a 5% 1,2-dimethoxyethane solution of poly(vinyl butyral) (trade name #6000C, manufactured by Denki Kagaku Kogyo K.K.) and with an appropriate amount of 1,2-dimethoxyethane to finally produce a dispersion having a solid concentration of 4.0%.

This dispersion was applied to the undercoat layer with a wire-wound bar in a thickness of 0.4 μm on a dry basis. Thereafter, the dispersion applied was dried to form a charge-generating layer.

Subsequently, 50 parts by mass of enamine compound CT-3 as a charge-transporting material, 100 parts by mass of a polyarylate resin X having the structure shown below, and 0.05 parts by mass of a silicone oil as a leveling agent were mixed with 640 parts by mass of a tetrahydrofuran/toluene mixed solvent (tetrahydrofuran, 80% by mass; toluene, 20% by mass) to prepare a coating fluid for charge-transporting-layer formation. This fluid was applied to the charge-generating layer with an applicator in a thickness of 25 μm on a dry basis. The coating fluid applied was dried at 125° C. for 20 minutes to form a charge-transporting layer. Thus, a photoreceptor sheet Al was produced. Incidentally, the polyarylate resin X had a viscosity-average molecular weight of 51,400.

The viscosity-average molecular weight of the polyarylate resin used was determined by the following method. The polyester resin is dissolved in dichloromethane to prepare a solution having a concentration C of 6.00 g/L. Using a Ubbelohde capillary viscometer having a solvent (dichloromethane) flow time t0 of 136.16 seconds, the sample solution is examined for flow time t in a thermostatic water bath set at 20.0° C. The viscosity-average molecular weight My is calculated according to the following equations.

$$a=0.438\times\eta_{sp}+1 \quad \eta_{sp}=t/t_0-1$$

$$b=100\times\eta_{sp}/C \quad C=6.00\ (g/L)$$

$$\eta=b/a$$

$$Mv=3207\times\eta^{1.205}$$

[Chem. 55]

X

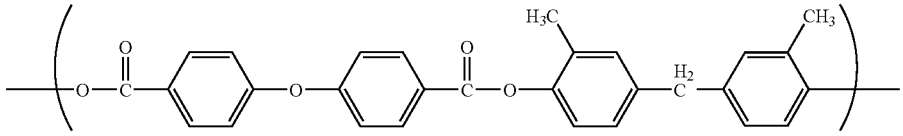

Example 2

Electrophotographic Photoreceptor A2

An electrophotographic photoreceptor A2 as an Example was obtained in the same manner as in Example 1, except that a polyarylate resin Y having the following structure was used in place of the polyarylate resin X and that the charge-transporting substance CT-3 was used. The polyarylate resin Y had a viscosity-average molecular weight of 51,700.

[Chem. 56]

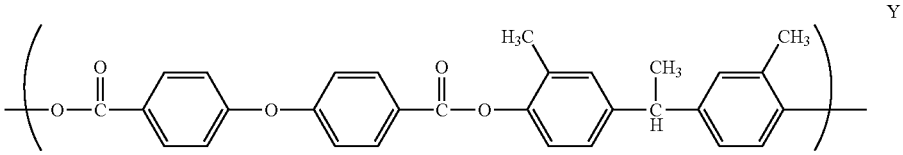

Y

Example 3

Electrophotographic Photoreceptor A3

An electrophotographic photoreceptor A3 as an Example was obtained in the same manner as in Example 1, except that a polyarylate resin Z having the following structure was used in place of the polyarylate resin X and that the charge-transporting substance CT-3 was used. The polyarylate resin Z had a viscosity-average molecular weight of 47,100.

[Chem. 57]

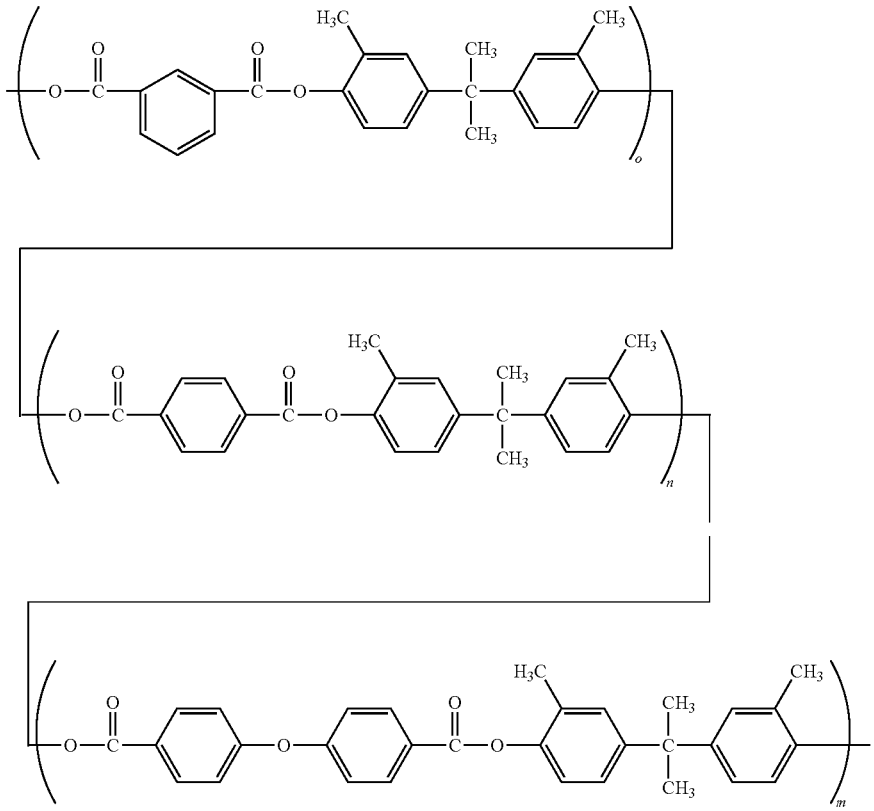

Z (m:n:o = 5:3:2)

Examples 4 to 15

Electrophotographic Photoreceptors A4 to A15

Electrophotographic photoreceptors A4 to A15 as Examples were obtained in the same manner as in Example 1, except that the polyarylate resins and charge-transporting substances shown in Table 2 were used.

Example 16

Electrophotographic Photoreceptor A16

An electrophotographic photoreceptor A 16 as an Example was obtained in the same manner as in Example 1, except that a polyarylate resin W having the following structure was used in place of the polyarylate resin X and that the charge-transporting substance CT-11 was used. The polyarylate resin W had a viscosity-average molecular weight of 50,300.

[Chem. 58]

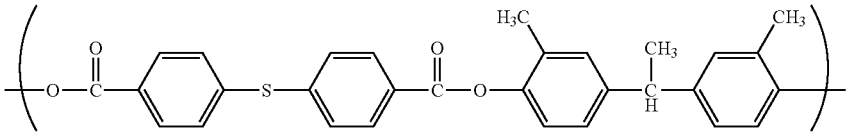

W

Comparative Example 1

Electrophotographic Photoreceptor P1

Using the polyarylate X, an electrophotographic photoreceptor P1 as a Comparative Example was obtained in the same manner as in Example 1, except that the charge-transporting substance CT-23 having the following structure was used in place of the charge-transporting substance CT-3.

[Chem. 59]

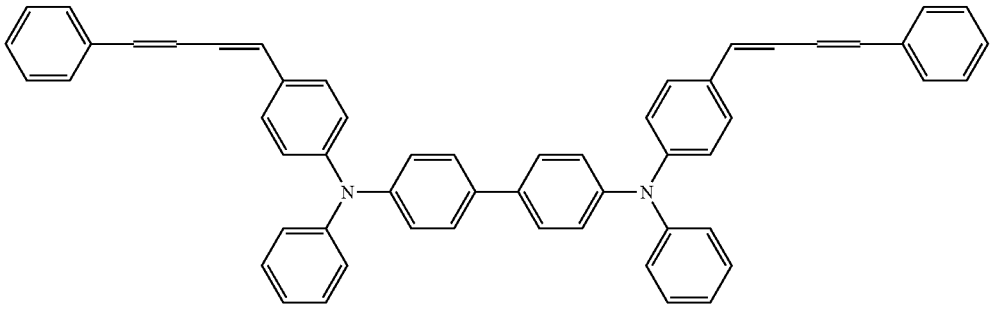

CT-23

Comparative Examples 2 and 3

Electrophotographic Photoreceptors P2 and P3

Electrophotographic photoreceptors P2 and P3 as Comparative Examples were obtained in the same manner as in Example 1, except that the charge-transporting substance CT-23 was used and that the polyarylate resins shown in Table 2 were used.

Comparative Example 4

Electrophotographic Photoreceptor P4

An electrophotographic photoreceptor P4 as a Comparative Example was obtained in the same manner as in Example 1, except that the polyarylate resin Y was used and that the charge-transporting substance CT-24 having the following structure was used in place of the charge-transporting substance CT-3.

[Chem. 60]

CT-24

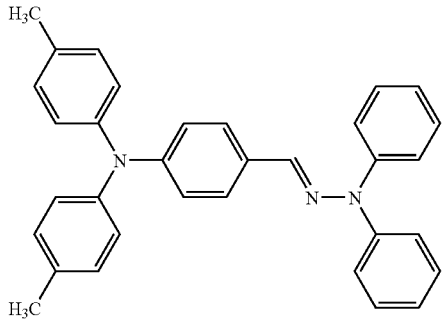

Comparative Example 5

Electrophotographic Photoreceptor P5

An electrophotographic photoreceptor P5 as a Comparative Example was obtained in the same manner as in Example 1, except that the polyarylate resin Y was used and that the charge-transporting substance CT-25 having the following structure was used in place of the charge-transporting substance CT-3.

[Chem. 61]

CT-25

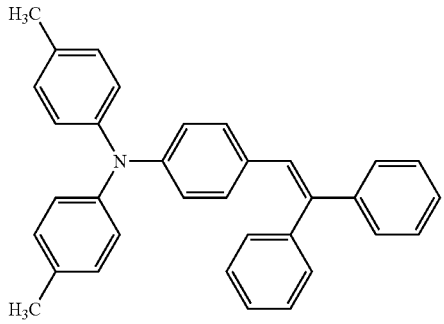

Comparative Example 6

Electrophotographic Photoreceptor P6

An electrophotographic photoreceptor P6 as a Comparative Example was obtained in the same manner as in Example 1, except that the polyarylate resin Y was used and that the charge-transporting substance CT-26 having the following structure was used in place of the charge-transporting substance CT-3.

[Chem. 62]

CT-26

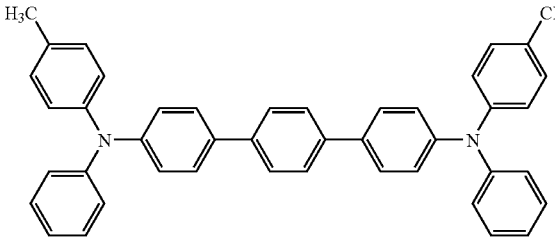

[Property Evaluation]

The electrophotographic photoreceptors Al to A 16 and P1 to P6 produced were subjected to the following electrical property test and abrasion test. The results of these tests are summarized in Table 2.

(Electrical Property Test)

An apparatus for electrophotographic-property evaluation produced in accordance with the measurement standards adopted by the Society of Electrophotography of Japan (described in the Society of Electrophotography of Japan ed., *Zoku Denshishashin Gijutsu No Kiso To Ōyō*, Corona Publishing Co., Ltd., pp.404-405) was used. Each of the photoreceptor sheets was bonded to an aluminum drum having an outer diameter of 80 mm so that the photoreceptor sheet came to have a cylindrical shape, and the aluminum drum was electrically connected to the aluminum base of the photoreceptor sheet. Thereafter, the drum was rotated at a constant rotation speed of 60 rpm and subjected to an electrical property evaluation test in which a cycle including charging, exposure, potential measurement, and erase was conducted. In this test, the photoreceptor was charged so as to result in an initial surface potential of −700 (minus 700; the same applies hereinafter) V, and exposed at 1.0 μJ/cm$^2$ to the monochromatic light of 780 nm obtained by converting the light from a halogen lamp with an interference filter. At 100 milliseconds after the exposure, the post-exposure surface potential (hereinafter sometimes referred to as VL) was measured. In the VL measurement, the time period from the exposure to the potential measurement was set at 100 ms, which was taken as conditions for high-speed response. Furthermore, half-decay exposure energy $E_{1/2}$ (μJ/cm$^2$), which is an energy required for the surface potential of the photoreceptor to change from −700 V to −350 V, was determined. This measurement was made in an environment having a temperature of 25° C. and a relative humidity of 50% (hereinafter sometimes referred to as NN environment) and in an environment having a temperature of 5° C. and a relative humidity of 10% (hereinafter sometimes referred to as LL environment). The results obtained are shown in Table 2.

(Abrasion Test)

A disk having a diameter of 10 cm was cut out of each of the photoreceptor sheets and subjected to wear evaluation with a Taber abrasion tester (manufactured by Taber Industries Inc.). With respect to test conditions, the sample disk was rotated so as to make 1,000 revolutions in an atmosphere of 23° C. and 50% RH using abrading wheels CS-10F on which no load was imposed (i.e., under the load of the weight of the abrading wheels themselves). The resultant abrasion loss was determined by comparing the mass of the untested sample disk with that of the tested sample disk. The results thereof are shown in Table 2.

TABLE 2

| Example or Comparative Example | Photoreceptor | CTM | Polyarylate resin | $E_{1/2}$ (NN) (μJ/cm$^2$) | VL (NN) (−V) | $E_{1/2}$ (LL) (μJ/cm$^2$) | VL (LL) (−V) | Abrasion loss (mg) |
|---|---|---|---|---|---|---|---|---|
| Ex. 1 | A1 | CT-3 | X | 0.085 | 35 | 0.129 | 103 | 0.3 |
| Ex. 2 | A2 | CT-3 | Y | 0.083 | 34 | 0.128 | 101 | 0.2 |
| Ex. 3 | A3 | CT-3 | Z | 0.087 | 37 | 0.131 | 109 | 0.7 |
| Ex. 4 | A4 | CT-5 | X | 0.083 | 24 | 0.130 | 87 | 0.4 |
| Ex. 5 | A5 | CT-5 | Y | 0.080 | 22 | 0.128 | 82 | 0.3 |
| Ex. 6 | A6 | CT-5 | Z | 0.086 | 28 | 0.134 | 91 | 0.8 |
| Ex. 7 | A7 | CT-6 | X | 0.085 | 38 | 0.129 | 105 | 0.3 |
| Ex. 8 | A8 | CT-6 | Y | 0.081 | 33 | 0.126 | 97 | 0.2 |
| Ex. 9 | A9 | CT-6 | Z | 0.089 | 41 | 0.137 | 112 | 0.8 |
| Ex. 10 | A10 | CT-11 | X | 0.084 | 29 | 0.127 | 91 | 0.4 |
| Ex. 11 | A11 | CT-11 | Y | 0.082 | 28 | 0.124 | 89 | 0.2 |
| Ex. 12 | A12 | CT-11 | Z | 0.085 | 30 | 0.129 | 95 | 0.8 |
| Ex. 13 | A13 | CT-20 | X | 0.077 | 51 | 0.115 | 114 | 0.3 |
| Ex. 14 | A14 | CT-20 | Y | 0.076 | 49 | 0.113 | 111 | 0.3 |
| Ex. 15 | A15 | CT-20 | Z | 0.077 | 53 | 0.119 | 119 | 0.9 |
| Ex. 16 | A16 | CT-11 | W | 0.085 | 33 | 0.130 | 97 | 0.4 |
| Comp. Ex. 1 | P1 | CT-23 | X | 0.097 | 109 | 0.191 | 212 | 0.5 |
| Comp. Ex. 2 | P2 | CT-23 | Y | 0.095 | 106 | 0.186 | 208 | 0.4 |
| Comp. Ex. 3 | P3 | CT-23 | Z | 0.100 | 113 | 0.196 | 221 | 0.9 |
| Comp. Ex. 4 | P4 | CT-24 | Y | 0.091 | 66 | 0.177 | 121 | 0.2 |
| Comp. Ex. 5 | P5 | CT-25 | Y | 0.095 | 90 | 0.184 | 177 | 0.3 |
| Comp. Ex. 6 | P6 | CT-26 | Y | 0.088 | 81 | 0.172 | 158 | 0.5 |

The following can be seen from the results given in Table 2. The photoreceptors of the invention including a polyarylate resin containing a diphenyl etherdicarboxylic acid residue or diphenyl thioetherdicarboxylic acid residue, like the photoreceptors A1 to A16 of Examples 1 to 16 and the photoreceptors P1 to P6 of Comparative Examples 1 to 6, have excellent wearing resistance as shown in the results of the Taber test. In particular, the photoreceptors including a polyarylate resin having a diphenyl etherdicarboxylic acid residue represented by general formula [9] are excellent in $E_{1/2}$ and VL and also in electrical properties, as apparent from a comparison of A10 to A12 and A16.

However, the photoreceptors of the invention including a polyarylate resin containing a diphenyl etherdicarboxylic acid residue or diphenyl thioetherdicarboxylic acid residue do not generally have excellent electrical properties, as shown in Comparative Examples 1 to 6. It should, however, be noted that the photoreceptors A 1 to A16, which employ charge-transporting substances (enamine compounds) represented by general formula [6], [7], or [7'] according to the invention, show preferred electrical properties as compared with the photoreceptors P1 to P6 of the Comparative Examples, which employ the charge-transporting materials CT-23 to CT-26 and are outside the scope of the invention. Namely, the charge-transporting substances (enamine compounds) represented by general formula [6], [7], or [7'] according to the invention unexpectedly improve the electrical properties of the photoreceptors which include a polyarylate resin containing a diphenyl etherdicarboxylic acid residue or diphenyl thioetherdicarboxylic acid residue and which do not have excellent electrical properties although excellent in wearing resistance. In particular, the photoreceptors A10 to A16, which contained enamine compounds represented by general formula [7] or [7'], showed especially satisfactory values.

<Evaluation of Responsiveness>

The photoreceptors obtained in Examples 8 and 10 to 15 and Comparative Examples 1 to 3 and 6 were examined for the hole drift mobility of the charge-transporting layer under the conditions of a field intensity E=2.0+5E (V/cm) and a temperature of 21° C. by the TOF method. The values of hole drift mobility of the electrophotographic photoreceptors A8, A10 to A15, P1 to P3, and P6 are shown in Tale 3.

TABLE 3

| Photoreceptor | Mobility (cm$^2$/Vs) |
|---|---|
| A8 | 2.27-5E |
| A10 | 5.31-6E |
| A11 | 5.43-6E |
| A12 | 5.42-6E |
| A13 | 1.01-5E |
| A14 | 1.15-5E |
| A15 | 9.98-6E |
| P1 | 3.67-6E |
| P2 | 3.89-6E |
| P3 | 3.54-6E |
| P6 | 6.63-6E |

As shown in Table 3, the electrophotographic photoreceptors A8 and A10 to A15 are higher in hole drift mobility than the electrophotographic photoreceptors P1 to P3. When the electrophotographic photoreceptor P6, which includes the charge-transporting substance CT-26 and has hitherto been regarded as high in hole drift mobility, is compared in hole drift mobility with the electrophotographic photoreceptors All and A14, which include the same polyarylate resin as in the electrophotographic photoreceptor P6, then it can be seen that the photoreceptors All and A 14 are equal in that property to the photoreceptor P6. Consequently, the photoreceptors A8 and A10 to A15, which employ a charge-transporting substance represented by general formula [6], [7], or [7'] according to the invention, are considered to be suitable for electrophotographic apparatus also from the standpoint of responsiveness, as compared with the photoreceptors P1 to P3 and P6 of Comparative Examples, which employ the charge-transporting material CT-23 or CT-26 and are outside the scope of the invention.

The HOMO energy levels (E_homo) and values of polarizability (αcal) of some of the charge-transporting materials used in the Examples are shown in Table 4. The higher the E_homo, the lower the VL. The higher the αcal, the higher the mobility. CT-6 and CT-11 according to the invention showed satisfactory electrical properties. On the other hand, CT-23 was low in E_homo although high in αcal, and CT-24 was low in αcal although high in E_homo. Neither CT-23 nor CT-24 can give satisfactory electrical properties. The charge-transporting materials according to the invention, which have values of E_homo and αcal in respective specific ranges, have an advantage in high-speed printers and high-speed copiers.

TABLE 4

| CTM | E_homo (eV) | αcal (Å$^3$) |
|---|---|---|
| CT-6 | −4.56 | 122.4 |
| CT-11 | −4.62 | 91.7 |
| CT-20 | −4.69 | 103.6 |
| CT-23* | | |
| ZZ (51%) | −4.71 | 103.2 |
| EZ (44%) | −4.69 | 103.9 |
| EE (5%) | −4.65 | 110.8 |
| CT-24 | −4.56 | 56.3 |

*With respect to CT-23, the results shown are for the geometrical isomers (proportions) given in the Example 1 of JP-A-2002-80432.

[Chem. 64]

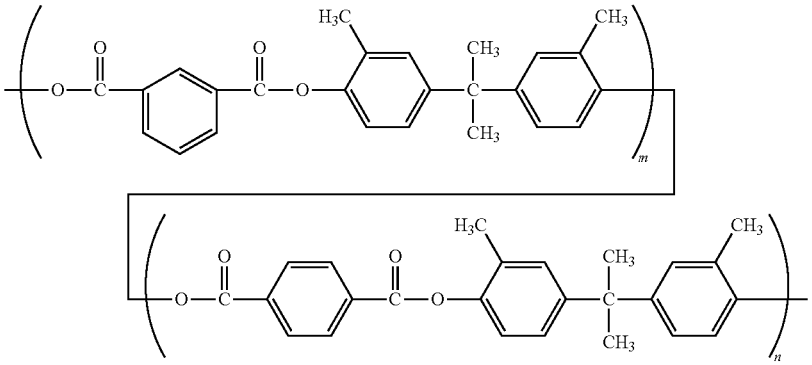

(m:n = 1:1)

Example17

Electrophotographic Photoreceptor B1

An electrophotographic photoreceptor was produced in the same manner as in Example 1, except that a charge-transporting layer was formed by the method shown below.

Fifty parts of the charge-transporting material (CT-9) synthesized in Production Example 1, 100 parts of a polyarylate resin M having the following structure, and 0.05 parts of a silicone oil as a leveling agent were mixed with 640 parts of a tetrahydrofuran/toluene mixed solvent (tetrahydrofuran, 80% by mass; toluene, 20% by mass) to prepare a coating fluid for charge-transporting-layer formation. This fluid was applied to the charge-generating layer with an applicator in a thickness of 25 μm on a dry basis. The coating fluid applied was dried at 125° C. for 20 minutes to form a charge-transporting layer. Thus, a photoreceptor sheet B1 was produced. Incidentally, the polyarylate resin M had a viscosity-average molecular weight of 32,400.

[Chem. 63]

M

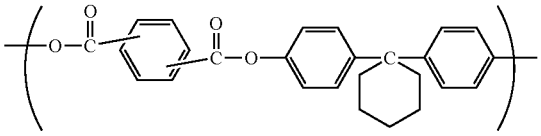

Example 18

Electrophotographic Photoreceptor B2

An electrophotographic photoreceptor B2 was obtained in the same manner as in Example 17, except that a polyarylate resin N having the following structure was used in place of the polyarylate resin M and that the charge-transporting material CT-9 was used. The polyarylate resin N can be produced by a known method. The polyarylate resin N had a viscosity-average molecular weight of 34,700.

Example 19

Electrophotographic Photoreceptor B3

An electrophotographic photoreceptor B3 was obtained in the same manner as in Example 17, except that a polyarylate resin P having the following structure was used in place of the polyarylate resin M and that the charge-transporting material CT-9 was used. The polyarylate resin P had a viscosity-average molecular weight of 31,000.

[Chem. 65]

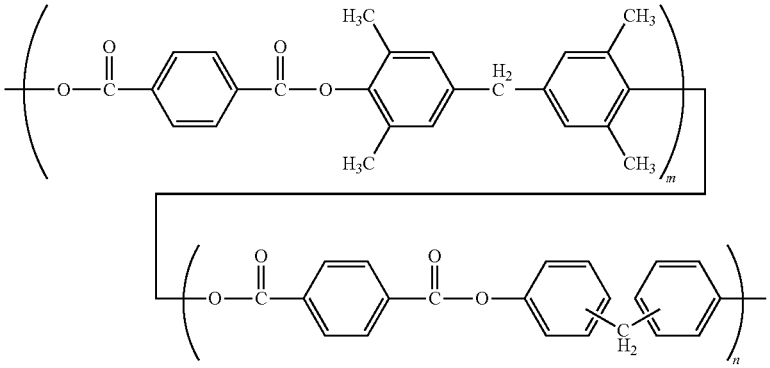

(m:n = 7:3)

Example 20

Electrophotographic Photoreceptor B4

An electrophotographic photoreceptor B4 was obtained in the same manner as in Example 17, except that a polyarylate resin Q having the following structure was used in place of the polyarylate resin M and that the charge-transporting material CT-9 was used. The polyarylate resin Q had a viscosity-average molecular weight of 33,500.

[Chem. 66]

Q

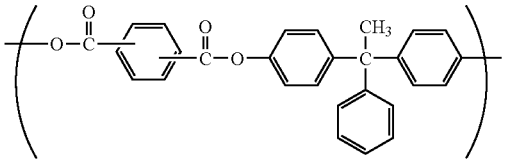

Examples 21 to 28

Electrophotographic Photoreceptors B5 to B12

Electrophotographic photoreceptors B5 to B12 were obtained in the same manner as in Example 17, except that the polyarylate resins and charge-transporting materials shown in Table 5 were used.

Comparative Example 7

Electrophotographic Photoreceptor Q1

An electrophotographic photoreceptor Q1 was produced in the same manner as in Example 17, except that a polyarylate resin R having the following structure was used in place of the polyarylate resin M and that the charge-transporting material CT-9 was used. The polyarylate resin R had a viscosity-average molecular weight of 37,200.

[Chem. 67]

R

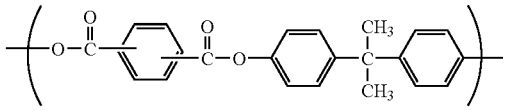

Comparative Example 8

Electrophotographic Photoreceptor Q2

An electrophotographic photoreceptor Q2 was produced in the same manner as in Example 17, except that a polyarylate resin S having the following structure was used in place of the polyarylate resin M and that the charge-transporting material CT-9 was used. The polyarylate resin S had a viscosity-average molecular weight of 40,000.

[Chem. 68]

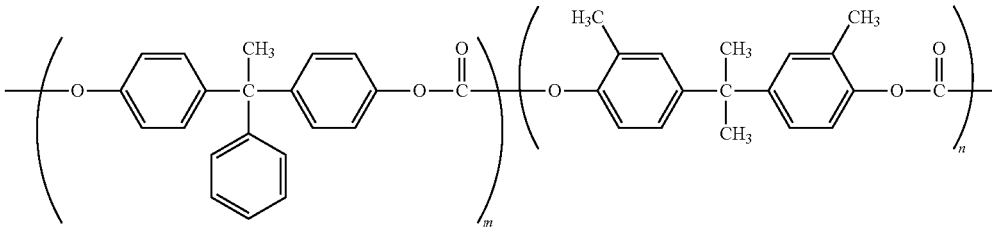

(m:n = 1:1)

Comparative Example 9

Electrophotographic Photoreceptor Q3

An electrophotographic photoreceptor Q3 was produced in the same manner as in Example 17, except that the polyarylate resin N was used in place of the polyarylate resin M and that a mixture of the charge-transporting materials CT-27 (25 parts) and CT-28 (25 parts) respectively having the following structures was used in place of the charge-transporting material CT-9.

[Chem. 69]

CT-27

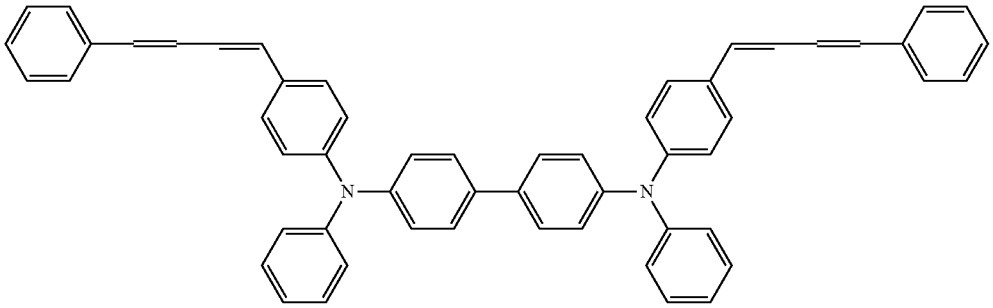

[Chem. 70]

CT-28

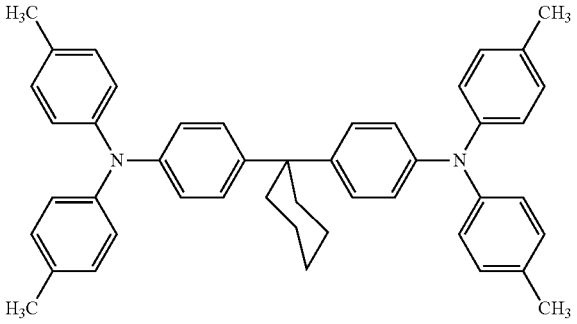

Comparative Example 10

Electrophotographic Photoreceptor Q4

An electrophotographic photoreceptor Q4 was obtained in the same manner as in Example 17, except that the polyarylate resin N was used in place of the polyarylate resin M and that the charge-transporting material CT-29 having the following structure was used in place of the charge-transporting material CT-9.

[Chem. 71]

CT-29

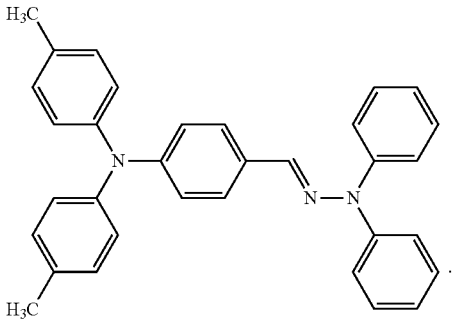

Comparative Example 11

Electrophotographic Photoreceptor Q5

An electrophotographic photoreceptor Q5 was obtained in the same manner as in Example 17, except that the polyarylate resin N was used in place of the polyarylate resin M and that the charge-transporting material CT-30 having the following structure was used in place of the charge-transporting material CT-9.

[Chem. 72]

CT-30

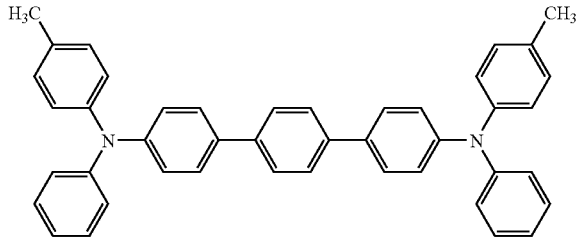

Comparative Example 12

Electrophotographic Photoreceptor Q6

An electrophotographic photoreceptor Q6 was obtained in the same manner as in Example 1, except that the polyarylate resin P was used in place of the polyarylate resin M and that CT-29 was used in place of the charge-transporting material CT-9.

Comparative Example 13

Electrophotographic Photoreceptor Q7

An electrophotographic photoreceptor Q7 was obtained in the same manner as in Example 1, except that the polyarylate resin P was used in place of the polyarylate resin M and that CT-30 was used in place of the charge-transporting material CT-9.

[Property Evaluation]

The electrophotographic photoreceptors B1 to B12 and Q1 to Q7 produced were subjected to the following electrical property test and abrasion test. The results of these tests are summarized in Table 5.

(Electrical Property Test)

An apparatus for electrophotographic-property evaluation produced in accordance with the measurement standards adopted by the Society of Electrophotography of Japan (described in the Society of Electrophotography of Japan ed., *Zoku Denshishashin Gijutsu No Kiso To Ōyō*, Corona Publishing Co., Ltd., pp.404-405) was used. Each of the photoreceptor sheets was bonded to an aluminum drum having an outer diameter of 80 mm so that the photoreceptor sheet came to have a cylindrical shape, and the aluminum drum was electrically connected to the aluminum base of the photoreceptor sheet. Thereafter, the drum was rotated at a constant rotation speed of 60 rpm and subjected to an electrical property evaluation test in which a cycle including charging, exposure, potential measurement, and erase was conducted. In this test, the photoreceptor was charged so as to result in an initial surface potential of −700 (minus 700; the same applies hereinafter) V, and exposed at 1.0 μJ/cm$^2$ to the monochromatic light of 780 nm obtained by converting the light from a halogen lamp with an interference filter. At 100 milliseconds after the exposure, the post-exposure surface potential (hereinafter sometimes referred to as VL) was measured. In the VL measurement, the time period from the exposure to the potential measurement was set at 100 ms, which was taken as conditions for high-speed response. Furthermore, half-decay exposure energy $E_{1/2}$ (μJ/cm$^2$), which is an energy required for the surface potential of the photoreceptor to change from −700 V to −350 V, was determined. This measurement was made in an environment having a temperature of 25° C. and a relative humidity of 50% (hereinafter sometimes referred to as NN environment) and in an environment having a temperature of 5° C. and a relative humidity of 10% (hereinafter sometimes referred to as LL environment). The results obtained are shown in Table 5.

(Abrasion Test)

A disk having a diameter of 10 cm was cut out of each of the photoreceptor sheets and subjected to wear evaluation with a Taber abrasion tester (manufactured by Taber Industries Inc.). With respect to test conditions, the sample disk was rotated so as to make 1,000 revolutions in an atmosphere of 23° C. and 50% RH using abrading wheels CS-10F on which no load was imposed (i.e., under the load of the weight of the abrading wheels themselves). The resultant abrasion loss was determined by comparing the mass of the untested sample disk with that of the tested sample disk. The results thereof are shown in Table 5.

TABLE 5

| Example or Comparative Example | Photoreceptor | CTM | Polyarylate resin | $E_{1/2}$ (NN) (μJ/cm$^2$) | VL (NN) (−V) | $E_{1/2}$ (LL) (μJ/cm$^2$) | VL (LL) (−V) | Abrasion loss (mg) |
|---|---|---|---|---|---|---|---|---|
| Ex. 17 | B1 | CT-9 | M | 0.089 | 42 | 0.139 | 133 | 2.2 |
| Ex. 18 | B2 | CT-9 | N | 0.085 | 38 | 0.137 | 129 | 2.4 |
| Ex. 19 | B3 | CT-9 | P | 0.087 | 39 | 0.134 | 120 | 1.7 |
| Ex. 20 | B4 | CT-9 | Q | 0.086 | 40 | 0.136 | 130 | 2.3 |
| Ex. 21 | B5 | CT-11 | M | 0.089 | 41 | 0.138 | 135 | 2.3 |
| Ex. 22 | B6 | CT-11 | N | 0.086 | 39 | 0.140 | 131 | 2.6 |
| Ex. 23 | B7 | CT-11 | P | 0.083 | 37 | 0.133 | 119 | 1.9 |
| Ex. 24 | B8 | CT-11 | Q | 0.086 | 41 | 0.137 | 132 | 2.5 |
| Ex. 25 | B9 | CT-20 | M | 0.090 | 53 | 0.145 | 144 | 2.3 |
| Ex. 26 | B10 | CT-20 | N | 0.088 | 45 | 0.143 | 142 | 2.5 |
| Ex. 27 | B11 | CT-20 | P | 0.087 | 44 | 0.142 | 140 | 1.9 |
| Ex. 28 | B12 | CT-20 | Q | 0.090 | 55 | 0.148 | 147 | 2.6 |
| Comp. Ex. 7 | Q1 | CT-9 | R | 0.126 | 98 | 0.157 | 171 | 3.0 |
| Comp. Ex. 8 | Q2 | CT-9 | S | 0.083 | 35 | 0.135 | 114 | 5.4 |
| Comp. Ex. 9 | Q3 | CT-27, CT-28 (1:1) | N | 0.097 | 109 | 0.191 | 212 | 2.7 |
| Comp. Ex. 10 | Q4 | CT-29 | N | 0.092 | 83 | 0.176 | 187 | 2.5 |
| Comp. Ex. 11 | Q5 | CT-30 | N | 0.090 | 107 | 0.180 | 218 | 2.6 |
| Comp. Ex. 12 | Q6 | CT-29 | P | 0.090 | 77 | 0.174 | 182 | 1.9 |
| Comp. Ex. 13 | Q7 | CT-30 | P | 0.091 | 113 | 0.184 | 222 | 1.9 |

The following was found from the results given in Table 5. The photoreceptors employing a polyarylate resin represented by general formula [1] according to the invention and a charge-transporting material represented by general formula [7] or [7'] according to the invention have a most satisfactory balance between electrical properties and wearing resistance and show preferred properties as compared with the known polycarbonate resin S and polycarbonate resin R.

It was likewise found that the photoreceptors B1 to B 12, which employ charge-transporting materials represented by general formula [7] or [7'] according to the invention, show preferred electrical properties as compared with the photoreceptors Q3 to Q7 of Comparative Examples, which employ the charge-transporting materials CT-27 to CT-30 as charge-transporting materials outside the range according to the invention.

Example 29

Ten parts of A-form oxytitanium phthalocyanine having main diffraction peaks at Bragg angles)(2θ±0.2° of 9.3°, 13.2°, 26.2°, and 27.1° in an X-ray powder diffraction spectrum obtained with CuKα characteristic X-ray was mixed with 2.5 parts of poly(vinyl butyral) (trade name, Denka Butyral #6000C; manufactured by Denki Kagaku Kogyo K.K.), 2.5 parts of a phenoxy resin (trade name, PKHH; manufactured by Union Carbide Corp.), 450 parts of 1,2-dimethoxyethane, and 50 parts of 4-methoxy-4-methyl-2-pentanone. This mixture was subjected to a pulverization/dispersion treatment with a sand grinding mill. The dispersion thus obtained was applied, so as to result in a film thickness of 0.4 μm, to the surface of an aluminum tube which had a diameter of 30 mm and a length of 357 mm and the surface of which had undergone a treatment for alumite coating formation. Thus, a charge-generating layer was formed.

Subsequently, a solution obtained by dissolving 60 parts of the enamine compound CT-9 as a charge-transporting substance and 100 parts of the polyarylate M as a binder resin in 500 parts of a tetrahydrofuran/toluene mixed solvent (8:2 by mass) was applied to the charge-generating layer in a thickness of 33 μm on a dry basis to form a charge-transporting layer. Thus, a photoreceptor was produced. The photoreceptor obtained was mounted in the electrophotographic photoreceptor cartridge of digital copier GP405, manufactured by Canon Inc., and an image was formed. The image formed on the first sheet (initial image) and that on the 30,000th sheet (image after repeated printing) were evaluated for image quality. A surface potential meter was mounted in the copier in place of the developing device, and the surface potential of the photoreceptor was likewise measured at the time when a black solid image was formed on the first sheet (initial potential) and at the time when a black solid image was formed on the 30,000th sheet (potential after repeated printing). Furthermore, the resultant film loss of the photosensitive layer of this photoreceptor was determined from the thickness change of the photosensitive layer. The results obtained are shown in Table 6.

Examples 30 to 40

Electrophotographic Photoreceptors B14 to B24

Electrophotographic photoreceptors B14 to B24 as Examples were obtained in the same manner as in Example 29, except that the polyarylate resins and charge-transporting substances shown in Table 6 were used.

Comparative Examples 14 to 20

Electrophotographic Photoreceptors Q8 to Q14

Electrophotographic photoreceptors Q8 to Q14 as Comparative Examples were obtained in the same manner as in Example 29, except that the binder resins and charge-transporting substances shown in Table 6 were used.

(Adhesiveness Test)

The photosensitive layer of each electrophotographic photoreceptor obtained was crosshatch-wise incised with a cutting knife to make 10×10 squares (100 1-mm squares). Adhesiveness was evaluated based on the degree of the resultant peeling of the photosensitive layer.

Good: No peeling occurred.

Fair: Peeling occurred in 1-30%.

Poor: Peeling occurred in 30% or more.

The less the photosensitive layer peels off in the adhesiveness test, the more the photoreceptor withstands the loads imposed by contact members of a printer. Such photoreceptors are hence preferred. For example, the photoreceptors rated as poor in this test have a problem that when an image is printed on many sheets with a printer, the photosensitive layer peels off in the regions where the edges of the charging roller are in contact with the photoreceptor. In contrast, the photoreceptors rated as good are free from such a problem.

TABLE 6

| Example or Comparative Example | Photo-receptor | CTM | Binder resin | Film loss (μm) | Initial potential (−V) | Potential after repeated printing (−V) | Initial image | Image after repeated printing | Adhesiveness |
|---|---|---|---|---|---|---|---|---|---|
| Ex. 29 | B13 | CT-9 | M | 9.5 | 285 | 277 | good | good | fair |
| Ex. 30 | B14 | CT-9 | N | 9.7 | 288 | 278 | good | good | good |
| Ex. 31 | B15 | CT-9 | P | 9.0 | 285 | 275 | good | good | good |
| Ex. 32 | B16 | CT-9 | Q | 9.9 | 290 | 279 | good | good | poor |
| Ex. 33 | B17 | CT-11 | M | 9.5 | 286 | 277 | good | good | fair |
| Ex. 34 | B18 | CT-11 | N | 9.6 | 289 | 279 | good | good | good |
| Ex. 35 | B19 | CT-11 | P | 9.1 | 287 | 278 | good | good | good |
| Ex. 36 | B20 | CT-11 | Q | 9.8 | 285 | 274 | good | good | poor |
| Ex. 37 | B21 | CT-20 | M | 9.4 | 289 | 278 | good | good | fair |
| Ex. 38 | B22 | CT-20 | N | 9.7 | 291 | 280 | good | good | good |
| Ex. 39 | B23 | CT-20 | P | 8.9 | 288 | 279 | good | good | good |
| Ex. 40 | B24 | CT-20 | Q | 9.7 | 283 | 276 | good | good | poor |
| Comp. Ex. 14 | Q8 | CT-9 | R | 10.0 | 235 | 279 | High density | fogging defect | poor |
| Comp. Ex. 15 | Q9 | CT-9 | S | 14.7 | 262 | 281 | good | fogging defect | good |
| Comp. Ex. 16 | Q10 | CT-27, CT-28 (1:1) | N | 9.6 | 266 | 189 | good | high density/space disappearance in character | good |

TABLE 6-continued

| Example or Comparative Example | Photo-receptor | CTM | Binder resin | Film loss (μm) | Initial potential (−V) | Potential after repeated printing (−V) | Initial image | Image after repeated printing | Adhesiveness |
|---|---|---|---|---|---|---|---|---|---|
| Comp. Ex. 17 | Q11 | CT-29 | N | 9.6 | 399 | 379 | Low density | low density | good |
| Comp. Ex. 18 | Q12 | CT-30 | N | 9.7 | 231 | 164 | High density | high density/space disappearance in character | good |
| Comp. Ex. 19 | Q13 | CT-29 | P | 9.1 | 405 | 382 | Low density | low density | good |
| Comp. Ex. 20 | Q14 | CT-30 | P | 9.0 | 237 | 289 | High density | fogging defect | good |

The following can be seen from the results given in Table 6. Only when the photoreceptors have the constitution of the invention, the photosensitive layers are reduced in the film loss caused by wear in repeated use and the photoreceptors can form a satisfactory initial image and can give a satisfactory image even after repeated printing, i.e., repeated image formation. The results are analyzed below in more detail.

It can be seen from the results obtained in the Examples and Comparative Examples that the photosensitive layers of Examples 29 to 40 and Comparative Examples 16 to 20, which each employ a polyarylate resin represented by general formula [1] according to the invention, are superior in wearing resistance to the photosensitive layers of Comparative Examples 14 and 15, which do not employ the binder resin according to the invention.

Of these photosensitive layers, those in which $Ar^3$ and $Ar^4$ have a substituent have satisfactory adhesiveness and are especially preferred.

Furthermore, from the results for the cases where polyarylate resins according to the invention are employed (Examples 29 to 40 and Comparative Examples 16 to 20), it can be seen that when the charge-transporting materials CT-27 to CT-30, which are outside the range according to the invention, are used, the density of an initial image and the image density after repeated printing are hardly improved. It can therefore be understood that a proper density is obtained, throughout repeated printing, only with the photoreceptors employing both a polyarylate resin represented by general formula [1] according to the invention and a charge-transporting substance represented by general formula [7] or [7'] according to the invention.

The following can be seen from the results obtained in Comparative Example 14. In the case where the conventional polyarylate resin R is used as a binder resin, the photoreceptor is improved in film loss. However, because of poor compatibility between the binder resin R and the charge-transporting substance according to the invention, this photoreceptor, when used as it is, cannot attain a proper density and causes fogging defects.

Furthermore, the following can be seen from the results obtained in Comparative Example 15. In the case where the conventional polycarbonate resin S is used in combination with a charge-transporting substance according to the invention, this photoreceptor is apt to cause fogging defects due to a film loss, although the combination does not considerably influence the quality of image density.

It was ascertained from those results that remarkably satisfactory results are obtained only when a polyarylate resin represented by general formula [1] according to the invention is incorporated in combination with a charge-transporting substance represented by general formula [7] or [7'] according to the invention, as in Examples 17 to 40.

Example 41

The surface of an aluminum cylinder having a mirror-finished surface and having an outer diameter of 30 mm, length of 246 mm, and wall thickness of 0.75 mm was anodized. Thereafter, the surface was subjected to a pore-filling treatment with a pore-filling agent containing nickel acetate as a main component to thereby form an anodic oxide coating (alumite coating) of about 6 μm. This cylinder was successively coated by dip coating with the coating fluid for charge-generating-layer formation and coating fluid for charge-transporting-layer formation shown below, in thicknesses of 0.4 μm and 18 μm, respectively, on a dry basis. Thus, a charge-generating layer and a charge-transporting layer were formed to obtain a photoreceptor drum.

A coating fluid for charge-generating-layer formation was produced in the following manner. Twenty parts of oxytitanium phthalocyanine giving the X-ray diffraction spectrum shown in FIG. 2 was mixed as a charge-generating substance with 280 parts of 1,2-dimethoxyethane. This mixture was pulverized with a sand grinding mill for 2 hours to conduct a pulverization/dispersion treatment. Subsequently, the liquid obtained through the pulverization treatment was mixed with a binder solution obtained by dissolving 10 parts of poly (vinyl butyral) (trade name, "Denka Butyral" 46000C; manufactured by Denki Kagaku Kogyo K.K.) in a liquid mixture of 255 parts of 1,2-dimethoxyethane and 85 parts of 4-methoxy-4-methyl-2-pentanone and further with 230 parts of 1,2-dimethoxyethane. Thus, the coating fluid for charge-generating-layer formation was prepared.

A coating fluid for charge-transporting-layer formation was produced in the following manner. A hundred parts of the polyarylate resin Y' (viscosity-average molecular weight, 40,000), 50 parts of the charge-transporting material CT-11, 8 parts of the compound represented by the following formula (AOX1) as an antioxidant, 1 part of tribenzylamine as another antioxidant, and 0.05 parts of a silicone oil as a leveling agent were dissolved in 640 parts by mass of a tetrahydrofuran/toluene (8/2) mixed solvent to produce the coating fluid for charge-transporting-layer formation.

[Chem. 73]

Y'

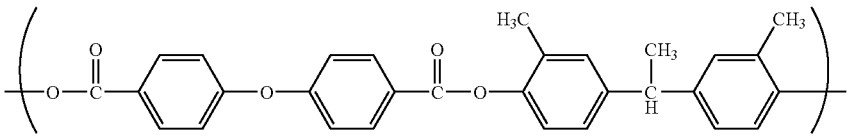

[Chem. 74]

AOX1

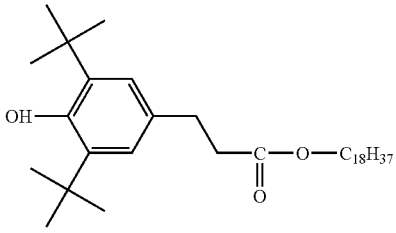

<Image Property Test>

The photoreceptor drum produced was mounted in the black drum of color printer C5900dn, manufactured by Oki Data Corp. Specifications of C5900dn:

Four-cartridge tandem

Color, 26 ppm; Monochrome, 32 ppm

Contact charging with roller (DC voltage application)

Contact development with nonmagnetic one-component

LED exposure

At the beginning and after image formation on 20,000 sheets, the image was examined for image defects such as, e.g., ghost, fogging, or decrease in density. The abrasion loss caused by the 20,000-sheet image formation was also examined. Furthermore, the <Electrical Property Test> and <Torque Test> explained below were conducted, and the results thereof are shown in Table 7.

<Electrical Property Test>

An apparatus for electrophotographic-property evaluation produced in accordance with the measurement standards adopted by the Society of Electrophotography of Japan (described in the Society of Electrophotography of Japan ed., *Zoku Denshishashin Gijutsu No Kiso To Ōyō*, Corona Publishing Co., Ltd., pp.404-405) was used. The photoreceptor drum was rotated at a constant rotation speed and subjected to an electrical property evaluation test in which a cycle including charging, exposure, potential measurement, and erase was conducted. The initial surface potential was set at -700 V, and monochromatic light of 780 nm and monochromatic light of 660 nm were used as an exposure light and an erase light, respectively. At the time when the photoreceptor was irradiated with the exposure light at 1.0 μJ/cm$^2$, the resultant surface potential (VL) was measured. In the VL measurement, the time period from the exposure to the potential measurement was set at 100 ms. This measurement was made in an environment having a temperature of 25° C. and a relative humidity of 50% (NN environment). The smaller the absolute value of VL, the better the responsiveness (unit: -V).

A torque motor is rotated at 50 rpm, and the torque is measured while keeping the photoreceptor free from loads. This value of torque is referred to as T0. Subsequently, a blade made of a urethane rubber and having a length of 230 mm, width of 14 mm (including a free-part length of 8 mm), and thickness of 2 mm is pushed against the photoreceptor at a linear pressure of 24.5 g/cm so that the edge of the blade is parallel with the lengthwise direction for the photoreceptor and that the blade forms an angle of 20° with the tangent to the photoreceptor surface. A slight amount of a toner was adhered to the blade edge with a writing brush.

The photoreceptor is rotated at 50 rpm with the torque motor, and the torque outputted by the torque motor is measured. The values of torque obtained in the period from the time when 120 seconds have passed from the initiation of the measurement to the time when 130 seconds have passed therefrom are averaged, and this value is referred to as Tm. The torque measured under no loads (T0) determined above was subtracted from Tm, and this value was taken as the value of torque generated by the pushing of the blade against the photoreceptor. This torque value was used as an index to the slip properties of the photoreceptor. The smaller the torque value, the better the slip properties of the photoreceptor.

Example 42 and Comparative Examples 21 and 22

Electrophotographic photoreceptors were produced and evaluated in the same manners as in Example 41, except that the charge-transporting materials and binder resins shown in Table 7 were used.

TABLE 7

| | CTM | Resin | Initial VL (−V) | VL after repeated printing (−V) | Abrasion loss (μm) | Initial torque value (g · cm) | Torque value after repeated printing (g · cm) |
|---|---|---|---|---|---|---|---|
| Ex. 41 | CT-11 | Y' | 36 | 39 | 1.4 | 1145 | 661 |
| Ex. 42 | CT-20 | Y' | 47 | 50 | 1.4 | 1098 | 675 |
| Comp. Ex. 21 | CT-23 | Y' | 57 | 57 | 1.6 | 1101 | 860 |
| Comp. Ex. 22 | CT-29 | S | 39 | 38 | 3.3 | 891 | 680 |

The photoreceptors of Examples 41 and 42 each gave satisfactory results in the image property test. The use of CT-11 and CT-20 resulted in a smaller abrasion loss than the use of CT-23. With respect to a comparison in torque value after repeated printing, the cases where the charge-transporting materials according to the invention were used had smaller values. It is therefore thought that the load imposed on the photosensitive layers of the photoreceptors of the Examples decreased, resulting in the reduced abrasion loss.

It can be seen from those results that especially satisfactory properties are obtained when the enamine compounds according to the invention are used in combination with the polyarylate resin.

Example 43

An aluminum cylinder having an outer diameter of 30 mm, length of 326 mm, and wall thickness of 0.8 mm was successively coated, by dip coating, with the coating fluid for undercoat layer formation, coating fluid for charge-generating-layer formation, and coating fluid for charge-transporting-layer formation shown below, in thicknesses of 1.25 μm, 0.4 μm, and 20 μm, respectively, on a dry basis. Thus, an undercoat layer, charge-generating layer, and charge-transporting layer were formed to obtain a photoreceptor drum.

The coating fluid for undercoat layer formation used was the same as the coating fluid for undercoat layer formation produced in Example 1.

The coating fluid for charge-generating-layer formation used was a 1:1 mixture of the coating fluid for charge-generating-layer formation produced in Example 29 and the coating fluid for charge-generating-layer formation produced in Example 41.

The coating fluid for charge-transporting-layer formation used was the same as the coating fluid for charge-transporting-layer formation produced in Example 41.

The photoreceptor drum produced was mounted in the drum cartridge of digital copier AL-1600, manufactured by Sharp Corp., and this cartridge was mounted on the copier to conduct image formation on 10,000 sheets. As a result, a satisfactory image free from defects such as ghost, fogging, and decrease in density was obtained both at the beginning and after the 10,000-sheet image formation.

Example 44

Evaluation was conducted in the same manner as in Example 43, except that the coating fluid for charge-transporting-layer formation produced in Example 42 was used in place of the coating fluid for charge-transporting-layer formation used in Example 43.

A satisfactory image free from defects such as ghost, fogging, and decrease in density was obtained both at the beginning and after the 10,000-sheet image formation.

The invention was explained above with reference to embodiments which are thought to be most practical and preferred at present. However, the invention should not be construed as being limited to the embodiments disclosed in the description, and modifications can be suitably made therein so long as the modifications do not depart from the spirit or ideas which can be read from the claims and whole description. Any electrophotographic photoreceptor, electrophotographic photoreceptor cartridge, or image-forming apparatus which includes such a modification should also be understood to be within the technical scope of the invention.

INDUSTRIAL APPLICABILITY

The electrophotographic photoreceptors of the invention can be used in copiers, various printers, printing machines, etc.

The invention claimed is:

1. An electrophotographic photoreceptor comprising a conductive substrate and a photosensitive layer formed thereover, wherein the photosensitive layer contains at least a polyarylate resin having a repeating structure represented by formula [1] and a compound represented by formula [6]:

[1]

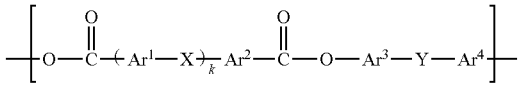

wherein in formula [1], $Ar^1$ to $Ar^4$ each independently represent an arylene group which may have a substituent; X is a single bond, an oxygen atom, a sulfur atom, a group represented by formula [2], or a group represented by formula [3]; $R^1$ and $R^2$ in formula [2] each independently represent a hydrogen atom, an alkyl group, or an aryl group, and $R^1$ and $R^2$ may be bonded to each other to form a ring; $R^3$ in formula [3] represents an alkylene group, an arylene group, or a group represented by formula [4]; $R^4$ and $R^5$ in formula [4] each independently represent an alkylene group; and $Ar^5$ represents an arylene group; k represents an integer of 1; and Y is a single bond, an oxygen atom, a sulfur atom, or a group represented by formula [5], wherein $R^6$ and $R^7$ each independently represent a hydrogen atom, an alkyl group, an alkoxy group, or an aryl group, and $R^6$ and $R^7$ may be bonded to each other to form a ring:

[2]

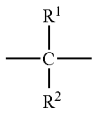

[3]

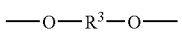

[4]

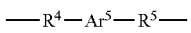

[5]

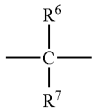

[6]

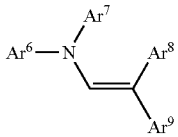

wherein in formula [6], $Ar^6$ to $Ar^9$ may be the same or different and each represent an aryl group which may have a substituent.

2. The electrophotographic photoreceptor according to claim 1, wherein X in formula [1] is an oxygen atom, a sulfur atom, the group represented by formula [2], or the group represented by formula [3].

3. The electrophotographic photoreceptor according to claim 1, wherein the photosensitive layer comprises a charge-generating layer and a charge-transporting layer, the charge-generating layer and the charge-transporting layer having been laminated in this order over the conductive substrate.

4. An electrophotographic cartridge comprising:

the electrophotographic photoreceptor according to claim 1; and at least one member selected from a charging device which charges the electrophotographic photoreceptor, an imagewise-exposure device which imagewise exposes the charged electrophotographic photoreceptor to light to form an electrostatic latent image, a developing device which develops the electrostatic latent image with a toner, a transfer device which transfers the toner to a receiving object, a fixing device which fixes the toner transferred to the receiving object, and a cleaner which recovers the toner adherent to the electrophotographic photoreceptor.

5. An image-forming apparatus comprising:

the electrophotographic photoreceptor according to claim 1;

a charging device which charges the electrophotographic photoreceptor;

an exposure device which exposes the charged electrophotographic photoreceptor to light to form an electrostatic latent image;

a developing device which develops the electrostatic latent image with a toner; and a transfer device which transfers the toner to a receiving object.

6. An electrophotographic photoreceptor comprising a conductive substrate and a photosensitive layer formed thereover, wherein the photosensitive layer contains at least one compound represented by formula [7']:

[7']

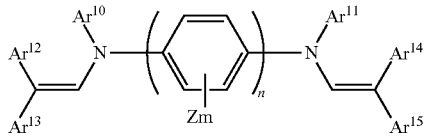

wherein in formula [7'], $Ar^{10'}$, $Ar^{11'}$, and $Ar^{12}$ to $Ar^{15}$ may be the same or different and each represent an aryl group which may have a substituent; n represents an integer of 2 or larger; Z represents a monovalent organic residue; and m represents an integer of 0 to 4, provided that at least one of $Ar^{10'}$ and $Ar^{11'}$ is an aryl group having a substituent.

7. The electrophotographic photoreceptor according to claim 6, wherein m is 0.

8. The electrophotographic photoreceptor according to claim 6, wherein the photosensitive layer comprises a charge-generating layer and a charge-transporting layer, the charge-generating layer and the charge-transporting layer having been laminated in this order over the conductive substrate.

9. An electrophotographic cartridge comprising:

the electrophotographic photoreceptor according to claim 6; and at least one member selected from a charging device which charges the electrophotographic photoreceptor, an imagewise-exposure device which imagewise exposes the charged electrophotographic photoreceptor to light to form an electrostatic latent image, a developing device which develops the electrostatic latent image with a toner, a transfer device which transfers the toner to a receiving object, a fixing device which fixes the toner transferred to the receiving object, and a cleaner which recovers the toner adherent to the electrophotographic photoreceptor.

10. An image-forming apparatus comprising:

the electrophotographic photoreceptor according to claim 6;

a charging device which charges the electrophotographic photoreceptor;

an exposure device which exposes the charged electrophotographic photoreceptor to light to form an electrostatic latent image;

a developing device which develops the electrostatic latent image with a toner; and a transfer device which transfers the toner to a receiving object.

11. An electrophotographic photoreceptor comprising a conductive substrate and a photosensitive layer formed thereover, wherein the photosensitive layer contains at least a polyarylate resin having a repeating structure represented by formula [1] and a compound represented by formula [7]:

[1]

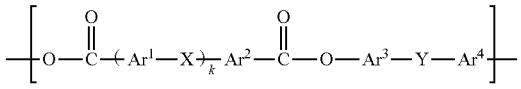

wherein in formula [1], $Ar^1$ to $Ar^4$ each independently represent an arylene group which may have a substituent; X is a single bond, an oxygen atom, a sulfur atom, a group represented by formula [2], or a group represented by formula [3]; $R^1$ and $R^2$ in formula [2] each independently represent a hydrogen atom, an alkyl group, or an aryl group, and $R^1$ and $R^2$ may be bonded to each other to form a ring; $R^3$ in formula [3] represents an alkylene group, an arylene group, or a group represented by formula [4]; $R^4$ and $R^5$ in formula [4] each independently represent an alkylene group; and $Ar^5$ represents an arylene group; k represents an integer of 0 to 5, provided that when k=0, either $Ar^3$ or $Ar^4$ is an arylene group having a substituent; and Y is a single bond, an oxygen atom, a sulfur atom, or a group represented by formula [5], wherein $R^6$ and $R^7$ each independently represent a hydrogen atom, an alkyl group, an alkoxy group, or an aryl group, and $R^6$ and $R^7$ may be bonded to each other to form a ring:

[2]

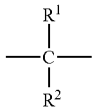

[3]

$$-O-R^3-O-$$

[4]

$$-R^4-Ar^5-R^5-$$

-continued

[5]

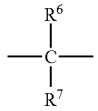

[7]

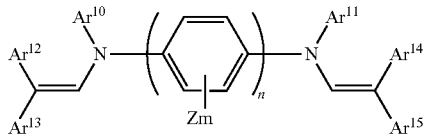

wherein in formula [7], $Ar^{10}$ to $Ar^{15}$ may be the same or different and each represent an aryl group which may have a substituent; n represents an integer of 2 or larger; Z represents a monovalent organic residue; and m represents an integer of 0 to 4.

12. The electrophotographic photoreceptor according to claim 11, wherein the photosensitive layer comprises a charge-generating layer and a charge-transporting layer, the charge-generating layer and the charge-transporting layer having been laminated in this order over the conductive substrate.

13. An electrophotographic cartridge comprising:

the electrophotographic photoreceptor according to claim 11; and at least one member selected from a charging device which charges the electrophotographic photoreceptor, an imagewise-exposure device which imagewise exposes the charged electrophotographic photoreceptor to light to form an electrostatic latent image, a developing device which develops the electrostatic latent image with a toner, a transfer device which transfers the toner to a receiving object, a fixing device which fixes the toner transferred to the receiving object, and a cleaner which recovers the toner adherent to the electrophotographic photoreceptor.

14. An image-forming apparatus comprising:

the electrophotographic photoreceptor according to claim 11;

a charging device which charges the electrophotographic photoreceptor;

an exposure device which exposes the charged electrophotographic photoreceptor to light to form an electrostatic latent image;

a developing device which develops the electrostatic latent image with a toner; and a transfer device which transfers the toner to a receiving object.

* * * * *